US011433693B2

(12) United States Patent
Furusawa et al.

(10) Patent No.: US 11,433,693 B2
(45) Date of Patent: Sep. 6, 2022

(54) RECORDING APPARATUS

(71) Applicant: SEIKO EPSON CORPORATION, Tokyo (JP)

(72) Inventors: Takuro Furusawa, Shiojiri (JP); Satoshi Yoshino, Matsumoto (JP); Kensuke Tamai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/132,316

(22) Filed: Dec. 23, 2020

(65) Prior Publication Data

US 2021/0197586 A1 Jul. 1, 2021

(30) Foreign Application Priority Data

Dec. 27, 2019 (JP) ..... JP2019-238605
Aug. 3, 2020 (JP) ..... JP2020-131888

(51) Int. Cl.

| | |
|---|---|
| ***B41J 11/08*** | (2006.01) |
| ***B41J 3/28*** | (2006.01) |
| ***B41J 3/407*** | (2006.01) |
| ***B41J 2/01*** | (2006.01) |
| ***B41J 13/00*** | (2006.01) |
| ***B41J 13/10*** | (2006.01) |
| ***B41J 11/04*** | (2006.01) |

(52) U.S. Cl.

CPC ..... *B41J 13/0018* (2013.01); *B41J 2/01* (2013.01); *B41J 3/28* (2013.01); *B41J 3/4071* (2013.01); *B41J 11/04* (2013.01); *B41J 11/08* (2013.01); *B41J 13/0027* (2013.01); *B41J 13/10* (2013.01)

(58) Field of Classification Search

CPC ... B41J 11/08; B41J 3/28; B41J 3/4071; B41J 2/01; B41J 13/0027; B41J 13/10

See application file for complete search history.

(56) References Cited

U.S. PATENT DOCUMENTS

| | | | | |
|---|---|---|---|---|
| 5,808,647 | A * | 9/1998 | Kurata | B41J 11/005 400/645 |
| 6,609,791 | B1 * | 8/2003 | Miyamoto | B41J 11/005 347/104 |
| 2016/0090254 | A1 | 3/2016 | Iijima et al. | |
| 2016/0243821 | A1 * | 8/2016 | Yoshida | B41J 11/0005 |

FOREIGN PATENT DOCUMENTS

| | | |
|---|---|---|
| JP | 2016-160025 | 9/2016 |
| JP | 6390307 | 9/2018 |
| JP | 6477018 | 3/2019 |

* cited by examiner

*Primary Examiner* — Matthew Luu
*Assistant Examiner* — Kendrick X Liu
(74) *Attorney, Agent, or Firm* — Workman Nydegger

(57) ABSTRACT

A recording apparatus includes a feed portion that feeds a medium, a transport portion that transports the fed medium in a transport direction, a recording portion that performs recording on the medium transported by the transport portion, a support member that includes a support surface that supports the medium on which the recording portion performs recording. The recording apparatus includes a pressing member that presses the medium towards the support member, at a position upstream of the recording position of the recording portion in the transport direction. The pressing member is provided so as to be movable in a direction intersecting the support surface.

14 Claims, 20 Drawing Sheets

RECORDING APPARATUS

The present application is based on, and claims priority from JP Application Serial Number 2019-238605, filed Dec. 27, 2019 and JP Application Serial Number 2020-131888, filed Aug. 3, 2020, the disclosures of which are hereby incorporated by reference herein in their entirety.

BACKGROUND

1. Technical Field

The present disclosure relates to a recording apparatus that includes a transport portion that transports a medium, a support portion that supports the medium, and a recording head that performs recording on the medium supported by the support portion.

2. Related Art

For example, JP-A-2016-160025 discloses a recording apparatus that includes a transport portion that transports a medium along a transport path, a recording head that discharges a liquid such as ink through nozzles to record an image on the transported medium, and a support member that supports the medium at a position in the transport path opposing the recording portion.

The transport portion includes pairs of transport rollers disposed upstream of the recording portion in the transport direction, and pairs of discharge rollers disposed downstream of the recording portion in the transport direction. The support member is configured to move between a first position, and a second position that is farther away from an imaginary plane including the nozzle surface than the first position. The support member includes first abutting members, abutting portions, and first biasing members. The first abutting members are disposed between discharge rollers adjacent to each other in the width direction. When the support member is in the first position, a protrusion end that protrudes to the transport path is positioned closer to the imaginary plane including the nozzle surface of the recording head than nip positions of the pair of discharge rollers that nip the medium. The abutting portion abuts against a discharge roller shaft while the support member is in the first position. The first biasing member biases the support member towards the first position.

The support member countering the biasing force of the first biasing member and moving from the first position to the second position changes the relative positional relationship between the nip position and the protrusion end of the first abutting member. With the above, a wave shape corresponding to the rigidity of the medium can be added to the medium. In the support member, since the position of the first position is set based on the discharge roller shaft, the positions of the nip position in the first position and the protrusion end of the first abutting member are set in an accurate manner.

However, there is an issue in the recording apparatus described in JP-A-2016-160025 in that, since the support member is a mechanism that moves up and down, the distance with the recording head is unstable and may lead to a decrease in the recording quality.

SUMMARY

A recording apparatus that overcomes the above issue is a recording apparatus that includes a feed portion that feeds a medium, a transport portion that transports the fed medium in a transport direction, a recording portion that performs recording on the medium transported by the transport portion, a support member that includes a support surface that supports the medium on which the recording portion performs recording, and a pressing member that presses the medium towards the support member, at a position upstream of the recording position of the recording portion in the transport direction. In the recording apparatus, the pressing member is provided so as to be movable in a direction intersecting the support surface.

DESCRIPTION OF EXEMPLARY EMBODIMENTS

First Exemplary Embodiment

Figure 1:
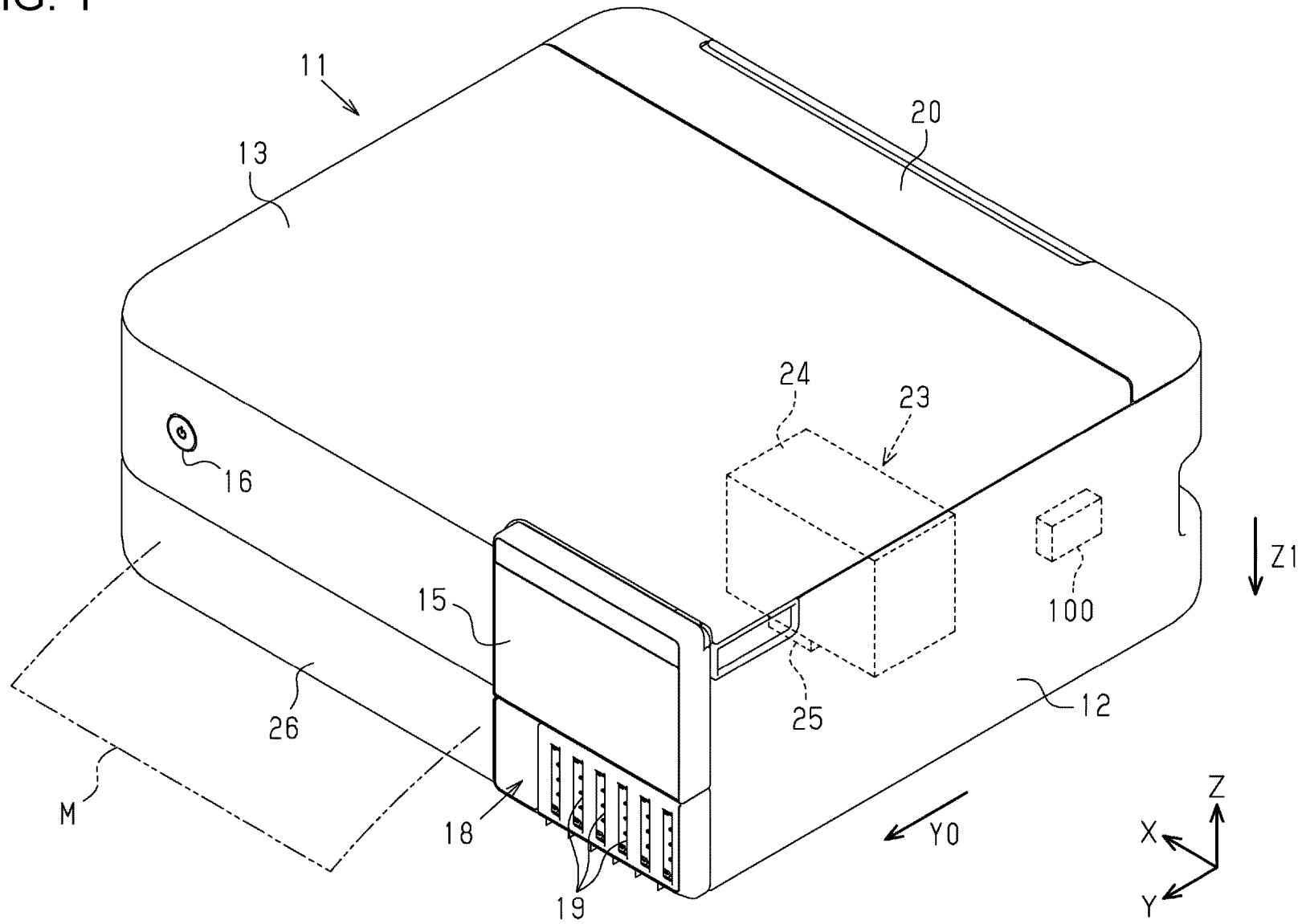
FIG. 1 is a perspective view of a recording apparatus according to a first exemplary embodiment.

Hereinafter, a first exemplary embodiment of a recording apparatus will be described with reference to the drawings. In FIG. 1, assuming that a recording apparatus 11 is placed on a horizontal surface, three virtual axes orthogonal to each other are denoted as an X-axis, a Y-axis, and a Z-axis. The X-axis is a virtual axis that is parallel to a scanning direction of the recording head described later, and the Y-axis is a virtual axis that is parallel to a transport direction of a medium during recording. Furthermore, the Z-axis is a virtual axis that is parallel to a vertical direction Z1. A direction parallel to the Y-axis indicates the transport direction of the medium at a recording position, which is where the recording head performs recording on the medium. The transport direction of the medium when a recording head 25 performs recording on the medium is referred to as a first transport direction Y1, and a direction opposite the first transport direction Y1 is referred to as a second transport direction Y2. Note that in the Y-axis, a surface side of the recording apparatus 11 on which an operation panel 15 described later is disposed is referred to the front, and a side opposite to the front is also referred to as the rear. Note that a transport path through which a medium M is transported is not necessarily parallel to the Y-axis throughout the entire area of the transport path, and a transport direction Y0 changes according to the position of the medium M on the transport path.

Configuration of Recording Apparatus

A recording apparatus 11 illustrated in FIG. 1 is an ink jet printer adopting a serial recording method. As illustrated in FIG. 1, the recording apparatus 11 includes an apparatus body 12 and a cover 13 provided at an upper portion of the apparatus body 12 in a openable/closable manner. The entire recording apparatus 11 has a substantially rectangular parallelepiped shape.

The recording apparatus 11 includes the operation panel 15 in a front surface thereof. The operation panel 15 includes an operation portion that includes operation buttons operated when issuing various commands to the recording apparatus 11, and a display portion that displays various menus and the operation status of the recording apparatus 11 (the operation portion and the display portion both not shown in the drawing). A power button 16 is further provided in the front surface of the apparatus body 12. Note that the display portion may be configured of a touch panel, and the operation portion may be configured of operation functions operated on the touch panel.

Furthermore, an accommodation portion 18 that accommodates at least one (six in the present exemplary embodiment) liquid supply source 17 (see FIG. 2) is provided in the front right side portion of the apparatus body 12. The accommodation portion 18 includes at least one (six in the present exemplary embodiment) window portion 19. Each window portion 19 corresponds to a liquid supply source 17. The window portions 19 are made of transparent or translucent resin. The user can visually confirm the liquid level of the liquid stored in each liquid supply source 17 through the corresponding window portion 19.

Furthermore, a feed cover 20 is provided in the upper rear portion of the recording apparatus 11 in an openable/closable manner. The feed cover 20 is opened/closed by being pivoted about a rear end thereof. A feed portion 21 is accommodated in the apparatus body 12 and on the inner side of the feed cover 20 that is in a closed position illustrated in FIG. 1. The feed portion 21 feeds the medium M such as a sheet of paper. The feed portion 21 includes a feed tray 22 (see FIG. 2) on which the medium M is mounted. The user mounts the medium M on the feed tray (see FIG. 2), which is exposed when the feed cover 20 is in an open position.

A recording portion 23 that performs recording on the medium M fed from the feed tray 22 is accommodated in the apparatus body 12. The recording portion 23 adopts a serial recording method, for example. The recording portion 23 adopting the serial recording method includes a carriage 24 configured to reciprocate in a scanning direction X, and the recording head 25 held below the carriage 24. A surface of the recording head 25 opposing the medium M transported along the transport path is a nozzle surface (see FIG. 6) in which a plurality of nozzles (not shown) are open. The liquid supply sources 17 and the recording portion 23 are coupled to each other through liquid supply tubes (not shown). A liquid from the liquid supply sources 17 is supplied to the recording head 25 through the liquid supply tubes.

The recording head 25 moving together with the carriage 24 discharges the liquid towards the medium M through the plurality of nozzles. A character or an image is recorded on the medium M by alternatively repeating a recording operation, in which the carriage 24 is moved once and in which the recording head 25 performs one-pass recording, and a transport operation in which the medium M is transported to the next recording position. Note that the recording portion 23 may adopt a line recording method. The recording portion 23 adopting the line recording method includes a recording head 25 that includes a line head including a plurality of nozzles configured to discharge the liquid simultaneously across the entire width of the medium with the largest width. Since the liquid is discharged to the medium M, which is transported at a fixed speed, through the nozzles of the recording head 25 configured of the line head in which the entire width of the medium M is subject to the discharge, high-speed recording on the image and the like can be achieved.

Furthermore, a discharge cover 26 is provided in a lower portion of the front surface of the recording apparatus 11 in an openable/closable manner. The discharge cover 26 pivots about a lower end thereof. In the apparatus body 12, a stacker 27 (see FIG. 4) used to receive the medium M to which recording has been performed is housed at the back of the discharge cover 26 in the closed position illustrated in FIG. 1. In a state in which the discharge cover 26 is open in the open position, the stacker 27 can be slid in the transport direction Y0 so that the stacker 27 is extended to a receiving position, which is where the medium M is received.

The recording apparatus 11 includes a control portion 100 that conducts various controls. The control portion 100 conducts control of the carriage 24 and the recording head 25, transport control of the medium M, display control of the operation panel 15, power supply control, and the like.

Figure 2:
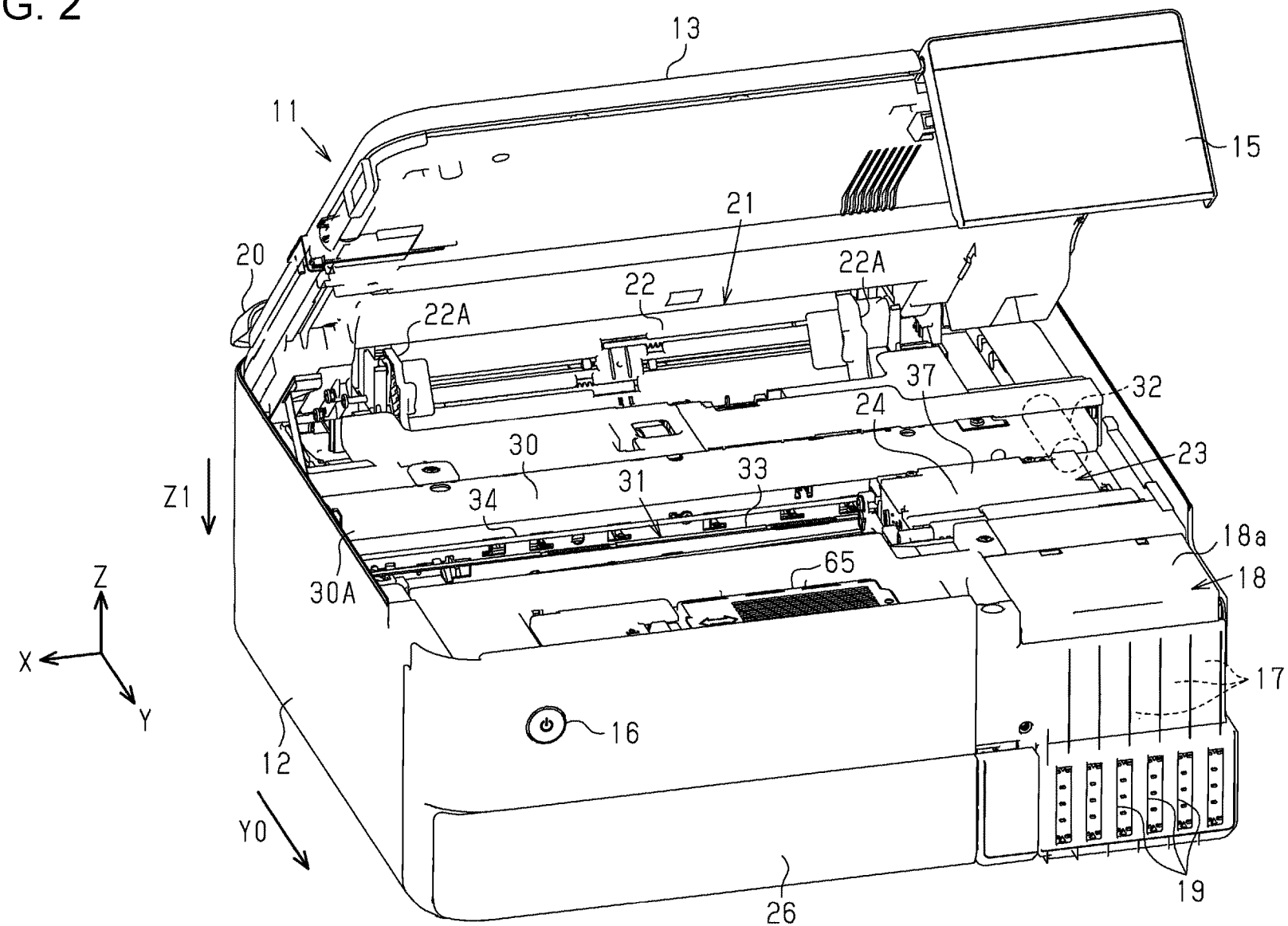
FIG. 2 is a perspective view illustrating the recording apparatus in a state in which a cover is open.
Figure 3:
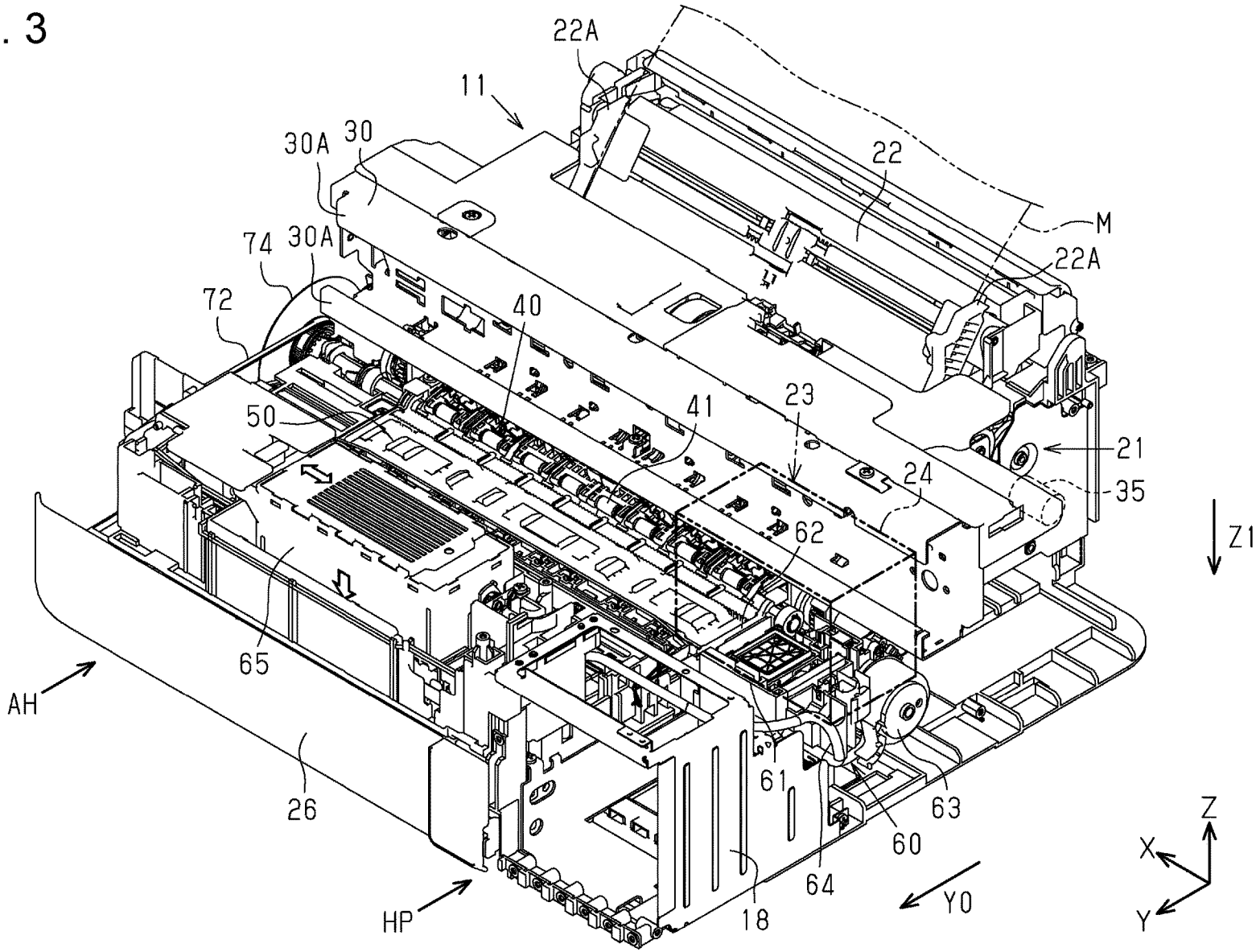
FIG. 3 is a perspective view illustrating the recording apparatus from which a housing has been detached.

Referring subsequently to FIGS. 2 and 3, a detailed inner configuration of the recording apparatus 11 will be described.

As illustrated in FIG. 2, a main frame 30 is provided so as to extend inside the apparatus body 12 in a width direction X. The main frame 30 includes a pair of guide rails 30A (also see FIG. 3) that guide the carriage 24. The pair of guide rails 30A parallel to each other extend in the scanning direction. The carriage 24 is supported at two portions in the vertical direction Z1 with the pair of guide rails 30A so as to be movable in the scanning direction (the width direction X). The carriage 24 guided by the pair of guide rails 30A is configured to reciprocate in the scanning direction. A moving mechanism 31 that moves the carriage 24 in the scanning direction is provided between the main frame 30 and the carriage 24. The moving mechanism 31 adopts a belt driven method, for example, and includes a carriage motor 32 that is a drive source of the carriage 24, and an endless timing belt 33 stretched across in the scanning direction. The carriage 24 is fixed to a portion of the timing belt 33. By rotation of the carriage motor 32 in the normal direction, the carriage 24 is made to reciprocate in the scanning direction through the timing belt 33.

Furthermore, a linear encoder 34 that extends in the scanning direction is provided in the main frame 30. The linear encoder 34 includes a linear scale that extends in the scanning direction, and a sensor attached to the carriage 24 (not shown). The sensor detects the linear scale and outputs pulse signals including pulses, the number of which is proportionate to the moving amount of the carriage 24.

A supply cover 18*a* that open/close the upper portion of the accommodation portion 18 is provided in the accommodation portion 18. In the present example, the liquid supply sources 17 are tanks in which a liquid is stored. When the user confirms, through the window portion 19, that the remaining amount of liquid in one of the liquid supply source 17 has become small, the user opens the cover 13 and the supply cover 18*a* and fills the liquid from a liquid bottle through a filling port (not shown) of the liquid supply source 17. Note that the liquid supply source 17 is not limited to a tank adopting a liquid filling method in which the user fills the liquid from a liquid bottle and may be a liquid pack (an ink pack, for example) or a liquid cartridge (an ink cartridge, for example) in which the liquid is stored. Furthermore, while the liquid supply source 17 is of an off-carriage type provided in the apparatus body 12, the liquid supply source 17 may be of an on-carriage type mounted on the carriage 24.

As illustrated in FIG. 3, a pair of edge guides 22A are provided in the feed tray 22 on which the medium M is mounted. By holding the medium M mounted on the feed tray 22 with the pair of edge guides 22A, the position of the medium M in the width direction X is set. The feed portion 21 includes a feed motor 35 serving as a drive source. The feed portion 21 feeds the medium M, which is mounted on the feed tray 22, along the transport path in the first transport direction Y1. The first transport direction Y1 is a transport direction when performing recording on the medium M.

As illustrated in FIG. 3, the recording apparatus 11 includes a transport portion 40 that transports the medium M, which has been fed from the feed portion 21, in the transport direction Y0. Furthermore, the recording apparatus 11 includes a support member 50 that supports a portion of the medium M where the recording portion 23 performs recording. The support member 50 is an elongated member extending in the width direction X and has a length capable of supporting the total area of a medium M with a maximum width in the width direction X. The recording portion 23 performs recording on a portion of the transported medium M that is supported by the support member 50.

The recording apparatus 11 includes a gap adjusting mechanism 37 that adjusts the gap between the recording portion 23 and the support member 50. The gap adjusting mechanism 37 is a mechanism that changes the height position of the recording head 25. The gap adjusting mechanism 37 adjusts the gap by changing the height position of the recording head 25. The control portion 100 controls the gap adjusting mechanism 37 so that the gap is adjusted according to the type of medium M. When the medium M is a sheet, for example, the type of medium M includes plain paper (thin paper, thick paper), photographic paper, an envelope, and a disk such as a CD-Recordable (CDR) and the like. Note that a medium M such as plain paper is a first medium with low rigidity, and a medium M such as photographic paper is a second medium with rigidity that is higher than that of the first medium.

The carriage 24 illustrated in FIG. 3 by a two-dot chain line is positioned at a home position HP that is a standby position in which recording is not performed. A maintenance apparatus 60 that performs maintenance on the recording head 25 is disposed at a position next to the support member 50 in the width direction X and at a position below the carriage 24 at the home position HP which opposes the carriage 24 at the home position HP. The maintenance apparatus 60 includes a cap 61 that caps the recording head 25 when the carriage 24 is at the home position HP, and a wiper 62 that wipes the nozzle surface of the recording head 25. By capping the recording head 25 with the cap 61, an increase in viscosity and drying of the liquid such as ink inside the nozzles of the recording head 25 are suppressed. When there is an increase in the viscosity of the liquid inside the nozzles, when there are air bubbles in the liquid inside the nozzles, or when the nozzles are blocked by foreign matters such as paper dust, discharge defects such as the liquid not being discharged through the nozzles in a normal manner occur due to the clogging of the nozzles.

The maintenance apparatus 60 cleans the nozzles of the recording head 25 to resolve or prevent such a type of discharge defect from occurring. The maintenance apparatus 60 includes a suction pump 63 that is in communication with the cap 61. The maintenance apparatus 60 drives the suction pump 63 under a capping state in which the cap 61 surrounding the nozzles is in contact with the nozzle surface of the recording head 25. When the suction pump 63 is driven, the liquid is forcibly suctioned and discharged from the nozzles due to the negative pressure introduced in the closed space between the nozzle surface and the cap 61. By forcibly suctioning and discharging the liquid with increased viscosity, air bubbles, and foreign matters such as paper dust from the nozzles, the nozzles recover from the discharge defect.

Furthermore, during a recording operation in which recording is performed on the medium M, by regularly or irregularly moving the recording portion to the home position HP and by performing blank discharging (also referred to as "flushing") in which droplets that are not related to recording are discharged towards the cap 61 from all of the nozzles, discharge defects during the recording are prevented. The liquid (waste liquid) discharged from the nozzles due to cleaning and blank discharging passes through a waste liquid tube 64 and is sent to a waste liquid tank 65 with the drive of the suction pump 63. The waste liquid tank 65 is positioned above an area downstream of the transport portion 40 in the transport direction Y0. When the user opens the cover 13, the waste liquid tank 65 is positioned on the near side; accordingly, the user can replace the waste liquid tank 65 from the front side of the recording apparatus 11.

Figure 4:
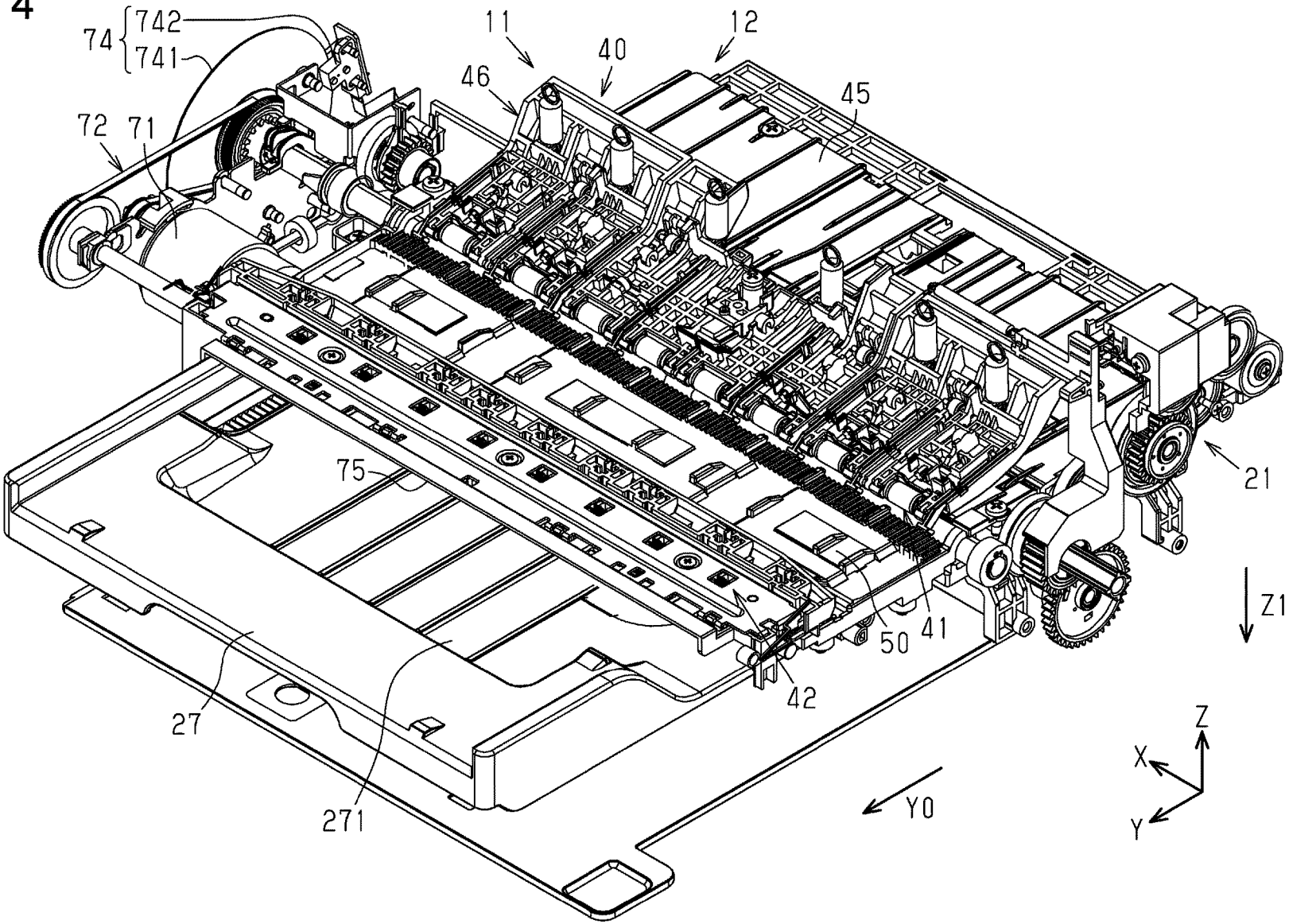
FIG. 4 is a perspective view illustrating a portion of the recording apparatus from which the housing has been detached.
Figure 5:
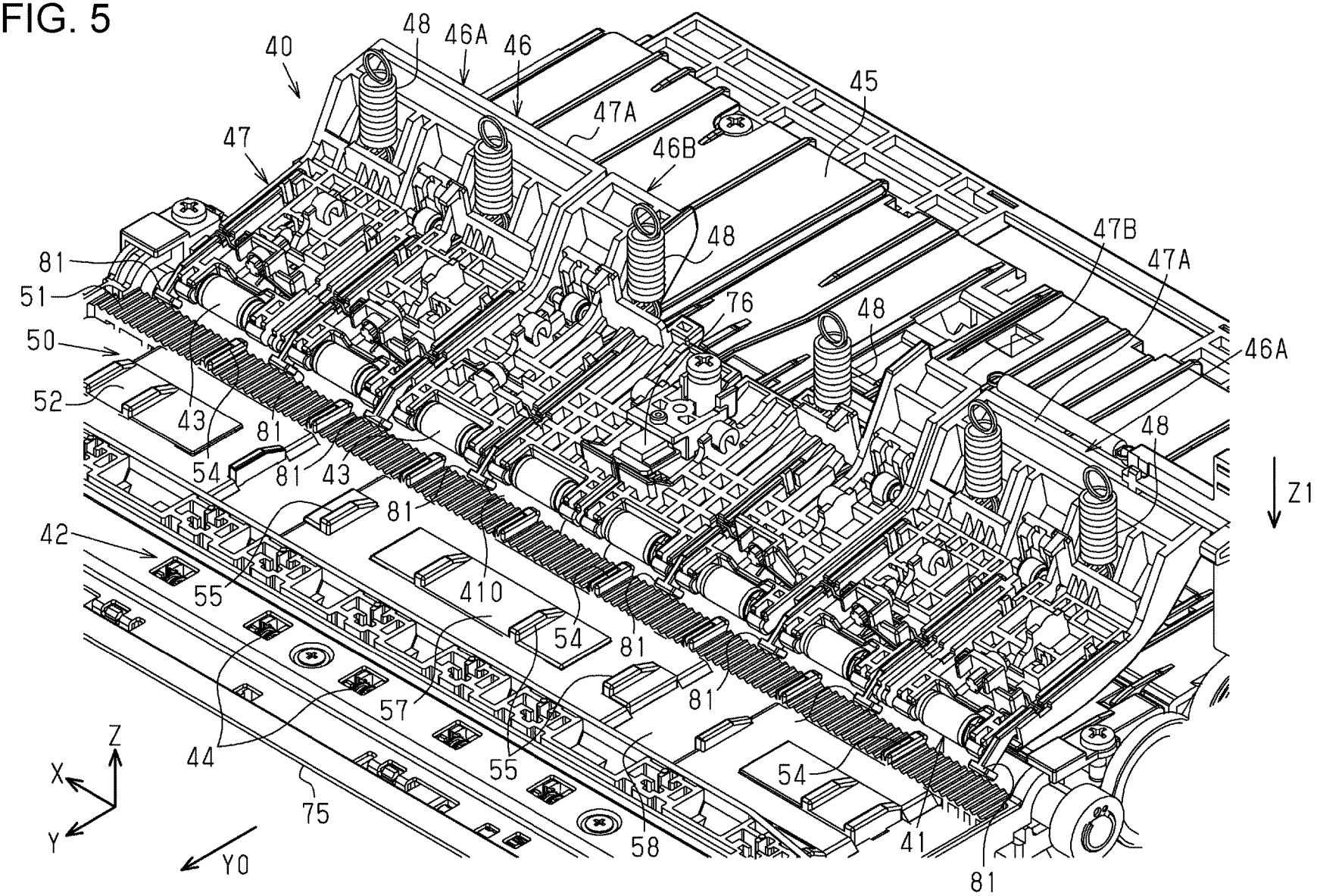
FIG. 5 is a perspective view illustrating a portion of a transport portion.
Figure 6:
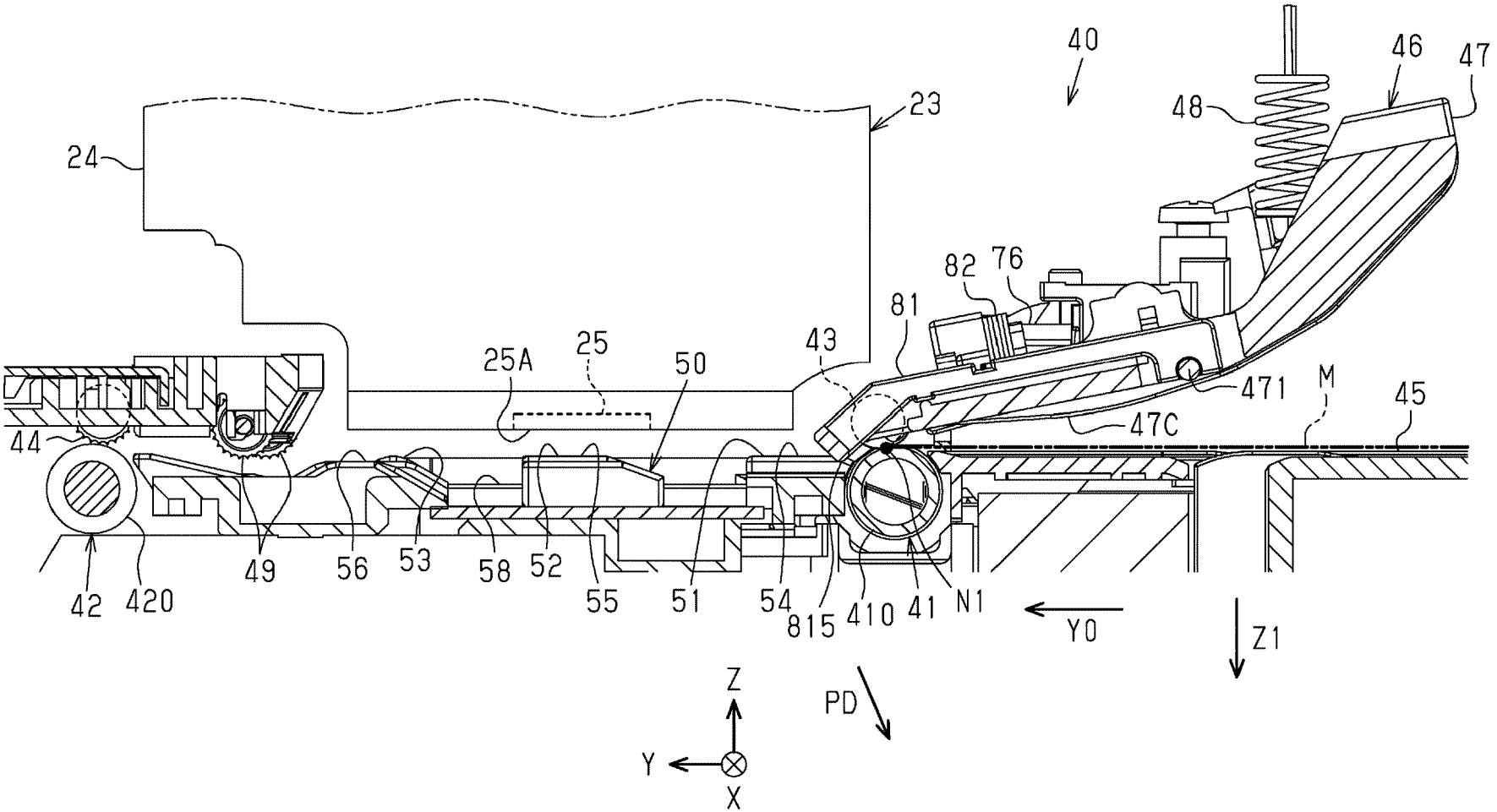
FIG. 6 is a side view illustrating portions of the transport portion and the recording portion

As illustrated in FIGS. 4 to 6, the transport portion 40 includes pairs of transport rollers 41 and pairs of discharge rollers 42 that interpose the support member 50 in between, in which the pairs of transport rollers 41 are disposed at a position upstream of the support member 50 in the transport direction Y0 and the pairs of discharge rollers 42 are disposed at a position downstream of the support member 50. As illustrated in FIGS. 5 and 6, the pair of transport rollers 41 are a pair configured of a transport driving roller 410 and driven rollers 43. Specifically, the pairs of transport rollers 41 are a pair configured of a single transport driving roller 410 and a plurality of driven rollers 43 that abut against the transport driving roller 410. The pairs of discharge rollers 42 are pairs configured of a plurality of discharge driving rollers 420 (see FIG. 6) and a plurality of driven rollers 44. The driven roller 44 is, for example, a star wheel including a plurality of teeth along the outer circumference thereof.

As illustrated in FIGS. 4 and 5, the transport portion 40 includes a plate-shaped medium guiding member 45 that supports a back surface of the fed medium M, and a medium guiding mechanism 46 disposed above the medium guiding member 45. As illustrated in FIG. 5, the medium guiding mechanism 46 includes a guide member 47 serving as an example of a pivoting member that is configured to pivot and to guide the medium M along the transport path, the plurality of driven rollers 43 supported at a downstream end portion of the guide member 47 in the transport direction Y0, and biasing members 48 that bias the guide member 47 in a direction in which the driven rollers 43 approaches the transport driving roller 410.

As illustrated in FIG. 4, the recording apparatus 11 includes a transport motor 71 that is a drive source of the transport portion 40, and a motive power transmission mechanism 72 that transmits motive power of the transport motor 71 to driving rollers 410 and 420 (see FIG. 6). The motive power transmission mechanism 72 includes a gear train that transmits the motive power of the transport motor 71 to the transport driving roller 410, a timing belt that transmits the rotation of the transport driving roller 410 to the discharge driving rollers 420, and the like. A rotary encoder 74 that detects the rotation of the transport driving roller 410 is provided in the recording apparatus 11. The rotary encoder 74 includes a rotary scale 741 fixed to an end portion of a rotation shaft of the transport driving roller 410, and an optical sensor 742 that detects the rotation of the rotary scale 741. The rotary encoder 74 outputs pulse signals that includes pulses, the number of which is proportionate to the rotation amount of the transport driving roller 410.

As illustrated in FIG. 4, the stacker 27 includes a square plate-shaped mounting portion 271. The stacker 27 moves between a retracted position illustrated in FIG. 4, and the receiving position which is where the stacker 27 has been slid downstream in the transport direction Y0 from the retracted position. A discharge opening 75 is open above the stacker 27, and the medium M to which recording has been performed is discharged through the discharge opening 75. The medium M to which recording has been performed and that has been discharged through the discharge opening 75 is mounted on the stacker 27 in the receiving position. The stacker 27 may be an electric stacker 27 that is driven by motive power of an electric motor, or may be of a manual type that is slid manually by the user.

The recording apparatus 11 of the present exemplary embodiment includes a label recording function that performs recording on a label surface of a disk such as a CDR. When the medium M is a disk and label recording that performs recording on the label surface is performed, the user sets the disk on a plate-shaped dedicated tray (not shown) and inserts the dedicated tray through the discharge opening 75. The dedicated tray is nipped between the pairs of transport rollers 41 and the pairs of discharge rollers 42. With the above, the disk is transported to the recording position where recording can be performed with the recording portion 23. The recording portion 23 records an image and the like on the label surface of the disk.

As illustrated in FIGS. 5 and 6, the support member 50 includes a first support portion 51 positioned at an upstream end portion of the support member 50 in the transport direction Y0, a main second support portion 52 positioned downstream of the first support portion 51 in the transport direction Y0, and a third support portion 53 positioned downstream of the second support portion 52 in the transport direction Y0. The first support portion 51 supports a portion of the medium M immediately after the medium M has been sent out by the pairs of transport rollers 41. The second support portion 52 is disposed in an area opposing the moving area of the recording head 25. The second support portion 52 supports a recording area of the medium M which is where the liquid discharged through the nozzles of the recording head 25 lands. The first support portion 51 supports an area of the medium M positioned upstream of the recording area in the transport direction Y0. The third support portion 53 supports a portion of the medium M where recording has been performed. The first support portion 51, the second support portion 52, and the third support portion 53 extend across an area that is slightly wider than the area in which the medium M having a maximum width in the width direction X is transported.

The first support portion 51 includes a plurality of first ribs 54 that protrude upwards while being arranged at intervals in the width direction X. The second support portion 52 includes a plurality of second ribs 55 that protrude upwards while being arranged at intervals in the width direction X. The third support portion 53 includes a plurality of third ribs 56 that protrude upwards while being arranged at intervals in the width direction X. The first ribs 54, the second ribs 55, and the third ribs 56 are disposed at the same positions in the width direction X. Accordingly, the second ribs 55 are positioned at positions downstream of the first ribs 54 in the transport direction Y0, and the second ribs 55 are positioned at positions upstream of the third ribs 56 in the transport direction Y0. An extra second rib 55 is provided on both sides that are outside the area in which the first ribs 54 are arranged. Accordingly, the number of second ribs 55 exceeds the number of first ribs 54 by two. Note that the positions of the ribs 54 to 56 in the width direction X are set according to the width size of the medium M so that when a regular-sized medium M is supported thereby, both end portions of the medium M in the width direction X can be supported. Accordingly, both end portions of any sized medium M of a regular size in the width direction X are supported by the ribs 54 to 56 during the transportation of the medium M.

Figure 7:
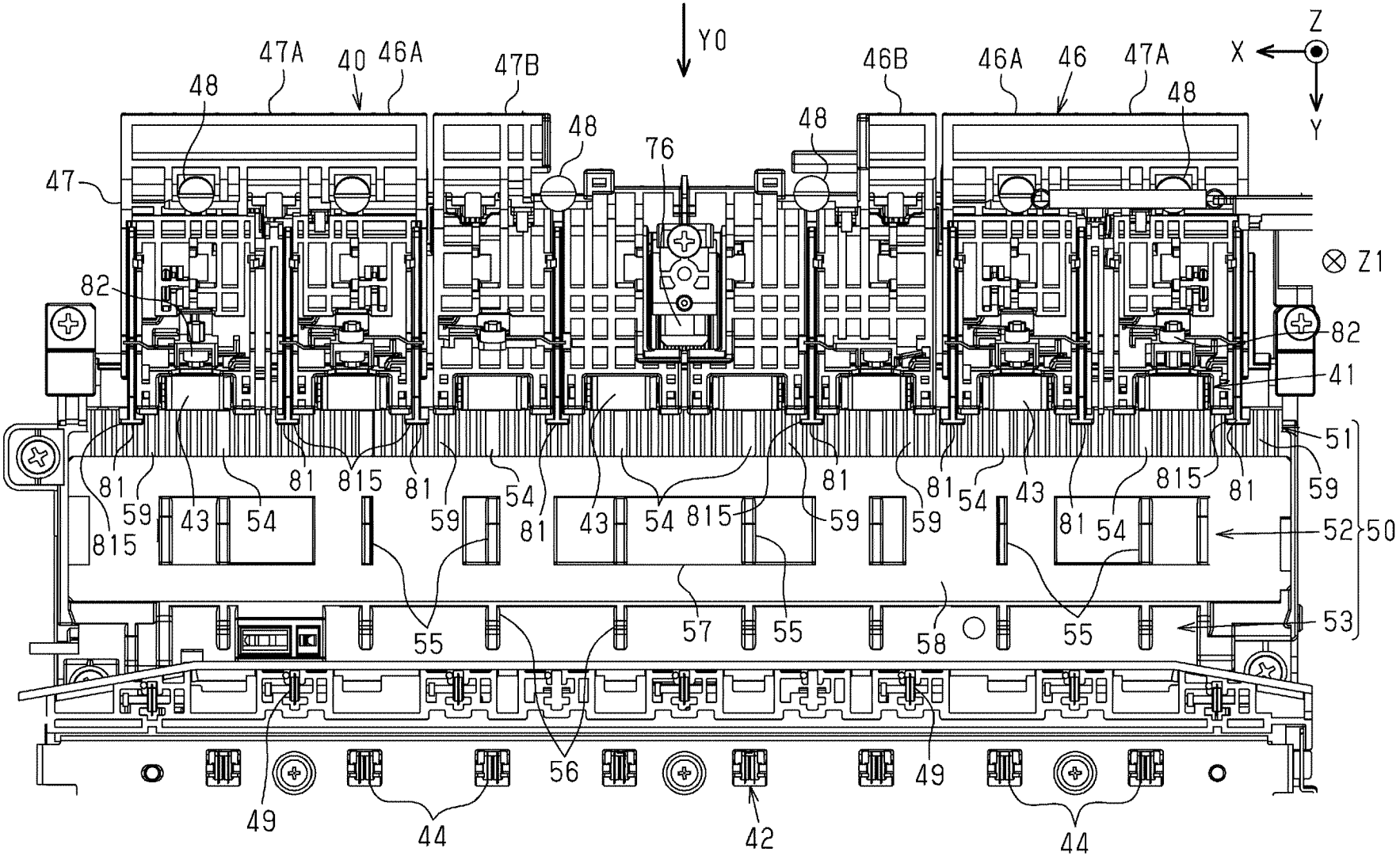
FIG. 7 is a plan view illustrating a portion of the transport portion.

As illustrated in FIGS. 5 to 7, the second support portion 52 includes substrate portions 57 in which one or two second ribs 55 protrude, and a liquid absorber 58 disposed so as to surround the substrate portions 57. The liquid absorber 58 is formed of a porous synthetic resin material and absorbs a liquid such as ink. The liquid absorber 58 is disposed at a position corresponding to the width size of the medium M so that the liquid discharged through the nozzles of the recording head 25 in a deviated manner to the outside of both end portions of the medium M in the width direction X can be absorbed when a regular-sized medium M is supported by the second ribs 55. Accordingly, when borderless recording, which records an image on a regular-sized medium M that can be dealt by the recording apparatus 11 so that there are no margins in the peripheral portions, is performed, the liquid deviated from both end portions of the medium M in the width direction X is absorbed by the liquid absorber 58. In other words, the liquid discharged in a deviated manner to the outside of the medium M during borderless printing can be prevented from adhering to the second ribs 55. Accordingly, the liquid adhered to the second ribs 55 being transferred to the back side of the medium M during transportation and staining the medium M with the liquid can be prevented.

As illustrated in FIGS. 5 and 7, the guide member 47 is configured of first guide members 47A and second guide members 47B. The guide member 47 in the present example is configured of two first guide members 47A and two second guide members 47B. The two first guide members 47A are disposed on both sides in the width direction X, and the two second guide members 47B are disposed next to each other and between the two first guide members 47A in the width direction X. In the present exemplary embodiment, the two first guide members 47A are same parts so that part communization is achieved. Note that the number of parts constituting the guide member 47 is not limited to four and may be any appropriate plural number.

As illustrated in FIGS. 5 and 7, a medium detector 76 that detects the medium M is attached to a middle portion of the guide member 47 in the width direction X. The medium detector 76 detects whether there is a medium M at a position upstream of the pair of transport rollers 41 in the transport direction Y0.

As illustrated in FIGS. 6 and 7, driven rollers 49 that are rotated when the medium M comes in contact thereto are provided at a position above the transport path and between the moving area of the recording portion 23 and the pairs of discharge rollers 42. The driven rollers 49 are star wheels, for example.

As illustrated in FIGS. 5 to 7, a plurality of pressing members 81 that press the transported medium M towards the support member 50 are provided in the medium guiding mechanism 46 at a plurality of portions at intervals in the width direction X. As illustrated in FIG. 6, the pressing members 81 each include abutting portions 815 that abut against the medium M when pressing down the medium M, and support shafts 471 that are pivot fulcrums positioned upstream of the abutting portions 815 in the transport direction Y0. Each pressing member 81 is provided so as to be pivotable within a predetermined angular range about the corresponding support shaft 471 while a rear end portion of the pressing member 81 is supported by the corresponding support shaft 471 of the guide member 47 constituting the medium guiding mechanism 46. The pressing members 81 are provided so as to be movable in a direction intersecting support surfaces 54A (see FIG. 13). The pressing members 81 are biased in a pressing direction in which the abutting portions 815 at the distal end portions thereof are allowed to press down the surface of the transported medium M with the elastic members 83 (see FIGS. 9 and 12) that constitute the biasing mechanisms 82. A pressing direction PD in which the pressing members 81 of the present example press down the medium M is a direction in which the medium M can be pressed against the support surfaces 54A of the support member 50. Referring to FIG. 6, the pressing direction PD is a direction parallel to a tangential line of an arcuate track at an intersection between the arcuate track of the abutting portion 815 about the support shaft 471 and a horizontal surface including a nip position N1 of the pair of transport rollers 41. Note that the pressing direction PD may be any direction that presses the transported medium M against the support surface 54A.

As illustrated in FIG. 6, the pressing member 81 includes, at the distal end portion thereof, the abutting portion 815 that abuts against the surface of the medium M that is to be pressed down therewith. In the present exemplary embodiment, the abutting portion 815 is positioned within a range that is, in the transport direction Y0, upstream of the recording head 25 and downstream of the nip positions N1 of the pairs of transport rollers 41. In other words, each pressing member 81 presses down a pre-recording portion of the surface of the medium M, which is downstream of the nip positions N1 of the pairs of transport rollers 41 in the transport direction Y0. For example, when the portion of the medium M where recording has been performed is pressed down by the pressing member, the ink is transferred to the pressing member and the transferred ink adheres to the medium M, which becomes a cause of stain in the image and the medium M. Conversely, in the present example, the pressing member 81 presses down the pre-recording portion of the medium M; accordingly, contamination such as ink is not transferred to the pressing member 81 when pressing down the medium M and there is no concern of the medium becoming stained. As described above, the pressing member 81 of the present exemplary embodiment being disposed at a position where the abutting portion 815 can be positioned within the range described above is a disposition condition of the pressing member 81.

Figure 8:
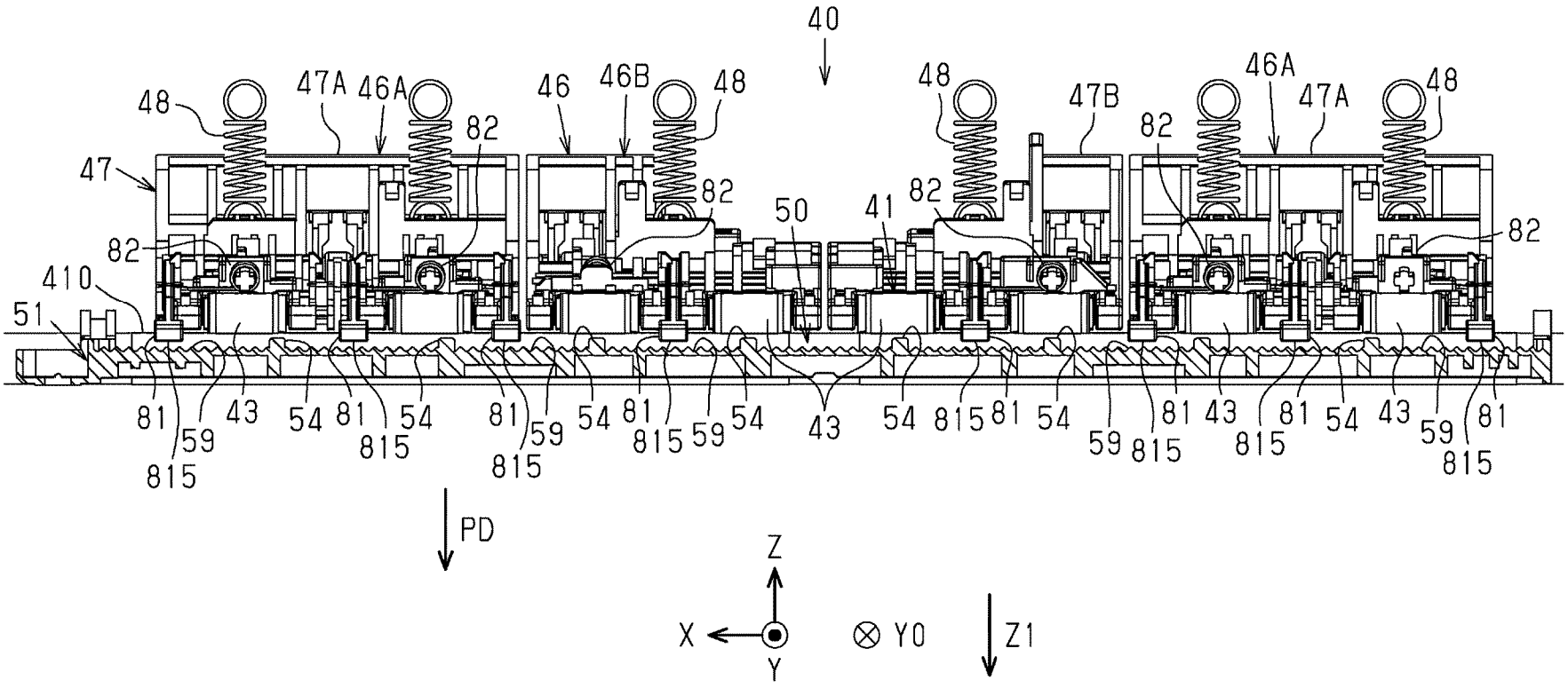
FIG. 8 is a cross-sectional view illustrating a portion of the transport portion.

As illustrated in FIGS. 7 and 8, the pressing members 81 are disposed at positions where the abutting portions 815 oppose recessed areas 59, which are between the ribs 54 in the width direction X of the support member 50. In other words, the pressing members 81 are disposed, in the vertical direction Z1, at positions opposing the recessed areas 59, which are not the ribs 54 that are protruded portions of the support member 50 having a protruded and recessed shape in the width direction X; accordingly, the rib 54 is positioned between two abutting portions 815 that are next to each other in the width direction X. Since the abutting portions 815 presses down the surface of the medium M at positions that are on both sides of the relevant rib 54 and that interpose the relevant rib 54 in between in the width direction X, the plurality of pressing members 81 curves the transported medium M so that the medium M has a wave shape illustrated in FIG. 14 that is wavy in the width direction X.

Note that the force needed to curve the medium M to have a wave shape can be small at portions that are close to the lateral edge portions of the medium M in the width direction X, which are free ends of the medium M. On the other hand, a large force will be needed to curve the middle portion of the medium M in the width direction X that is distanced away from the free ends of the medium M. In other words, the middle portion of the medium M in the width direction X is a position where it is difficult for the pressing members 81 to curve the medium M. Furthermore, as illustrated in FIG. 7, the medium detector 76 is disposed in the middle portion of the guide member 47 in the width direction X. It is difficult to secure a space for disposing the pressing member 81 in the area around the medium detector 76. Accordingly, in the present exemplary embodiment, the plurality of pressing members 81 are disposed in areas other than the middle portion of the medium guiding mechanism 46 in the width direction X.

Figure 14:
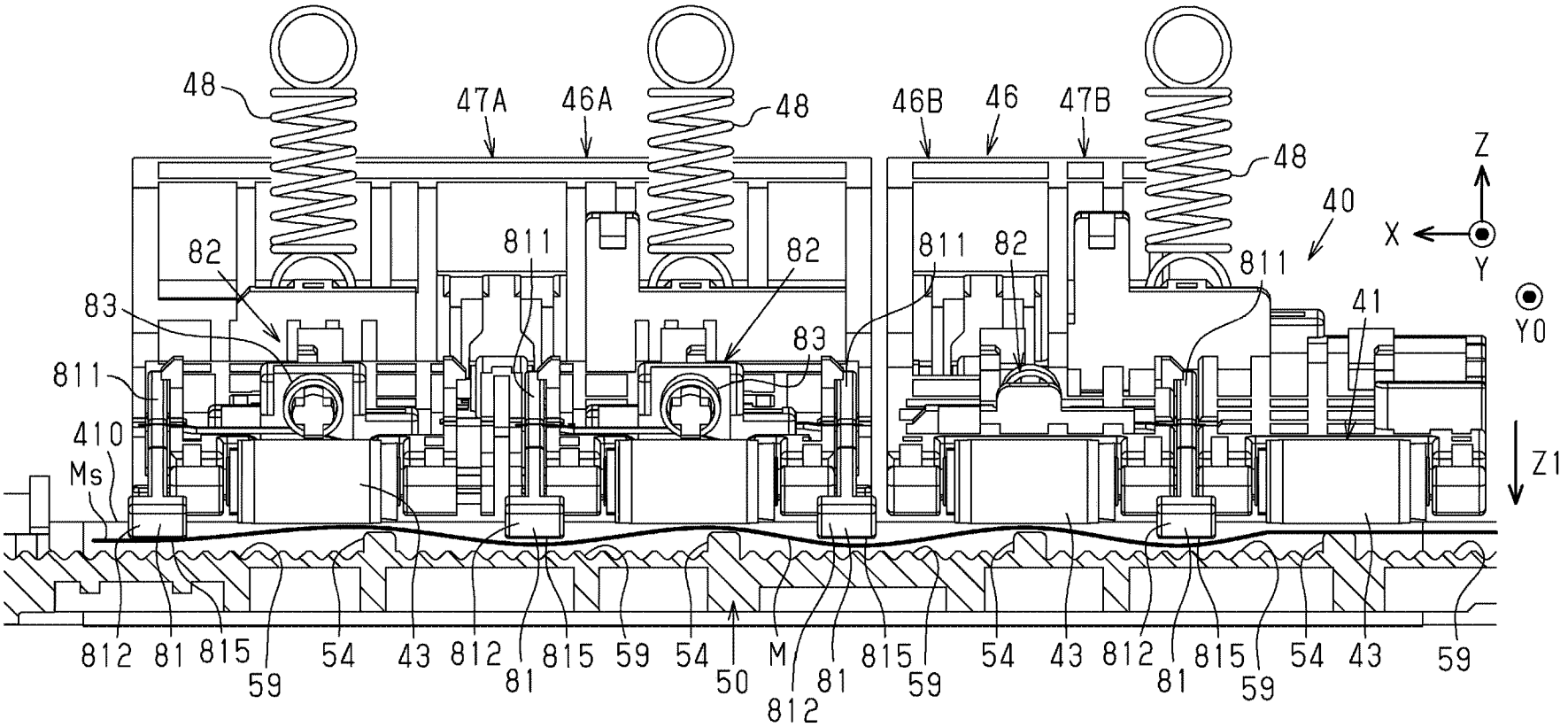
FIG. 14 is a regular cross section illustrating an action of the pressing members.

Among the plurality of pressing members 81, the pair of pressing members 81 at the outermost positions in the width direction X press down the two edge portions of the medium M, which has the largest width as illustrated in FIG. 14, in the width direction X. In other words, as illustrated in FIG. 14, the pair of pressing members 81 at the outermost positions in the width direction X are positioned, in the width direction X, between the ribs 54, among the plurality of ribs 54 supporting the medium M with the largest width, at the outermost position and the lateral edges Ms of the medium M with the largest width. The pressing members 81 are, at the least, provided at positions between the outermost ribs 54 that support the two edge portions of the medium M, which has the largest width, in the width direction X, and the ribs 54 positioned next to and inside the outermost ribs 54 in the width direction X.

As illustrated in FIGS. 7 and 8, the medium guiding mechanism 46 includes a pair of first guiding mechanisms 46A disposed on both sides in the width direction X, and a second guiding mechanism 46B disposed in the middle portion in the width direction X. The guide member 47 is configured of the pair of first guide members 47A that constitute the pair of first guiding mechanisms 46A, and the second guide members 47B that constitute the second guiding mechanism 46B. The pair of first guide members 47A are common parts. Note that an under surface of the guide member 47 that opposes the transport path of the medium M is a guide surface 47C (see FIGS. 6 and 9) that guides the medium M.

Figure 9:
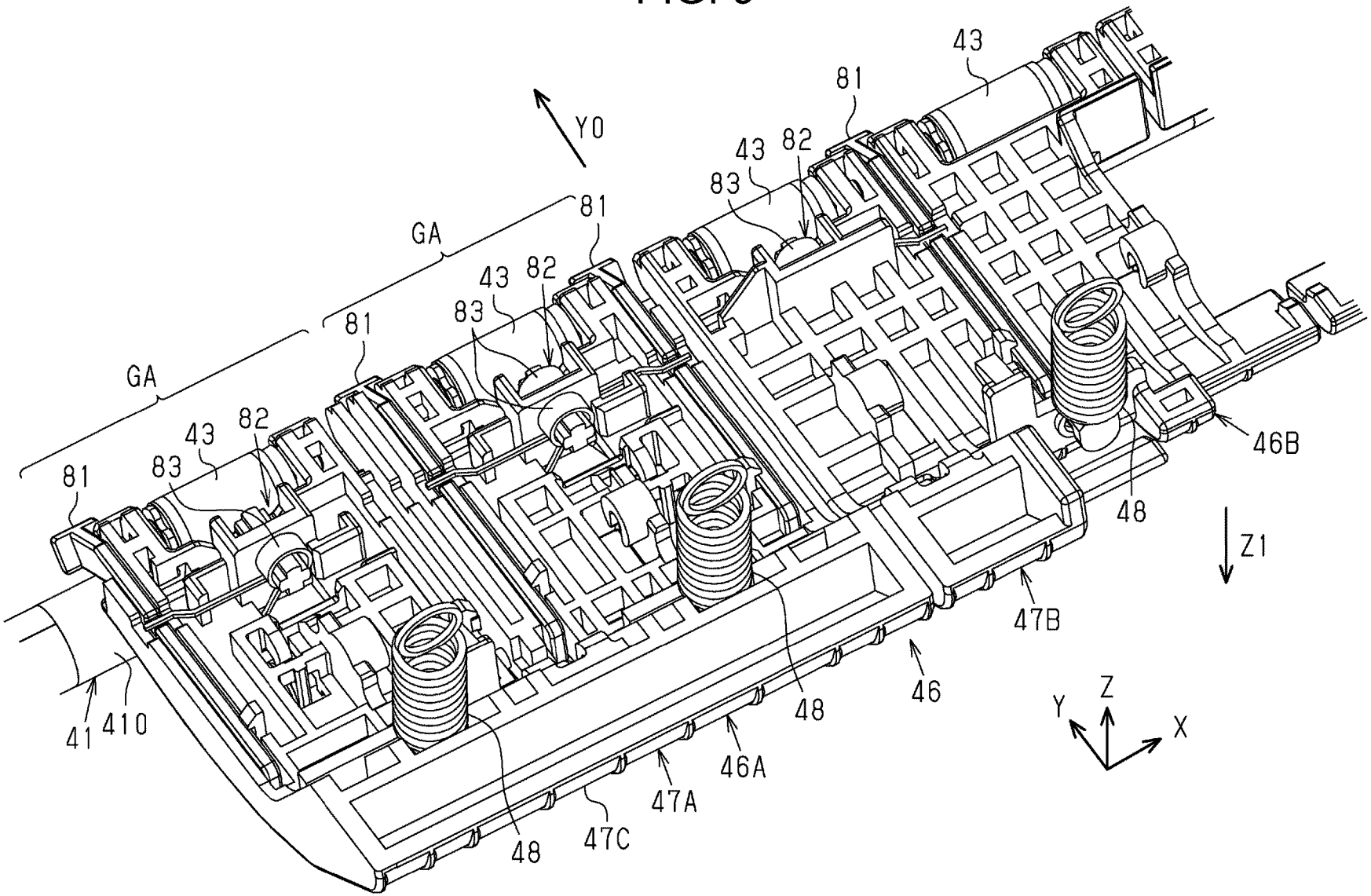
FIG. 9 is a perspective view illustrating a portion of a medium guiding mechanism.

As illustrated in FIG. 9, one of the first guiding mechanisms 46A is configured so that two areas GA halving the first guiding mechanism 46A in the width direction X have substantially the same structure. The two areas GA halving the first guide member 47A in the width direction X have substantially the same structure. Two driven rollers 43 rotatably supported at a downstream end portion in the transport direction Y0, and two biasing members 48 configured of coil springs that bias the two driven rollers 43 downwards in the vertical direction Z1 by pulling an upstream end portion in the transport direction Y0 upwards in the vertical direction Z1 are installed in the two areas GA of the first guide member 47A. Two biasing mechanisms 82 are disposed in the two areas GA of the first guide member 47A at positions interposed between the driven rollers 43 and the biasing members 48 in the transport direction Y0. Furthermore, in the first guide member 47A, three pressing members 81 are supported at positions that interpose the two driven rollers 43 in the width direction X.

Figure 10:
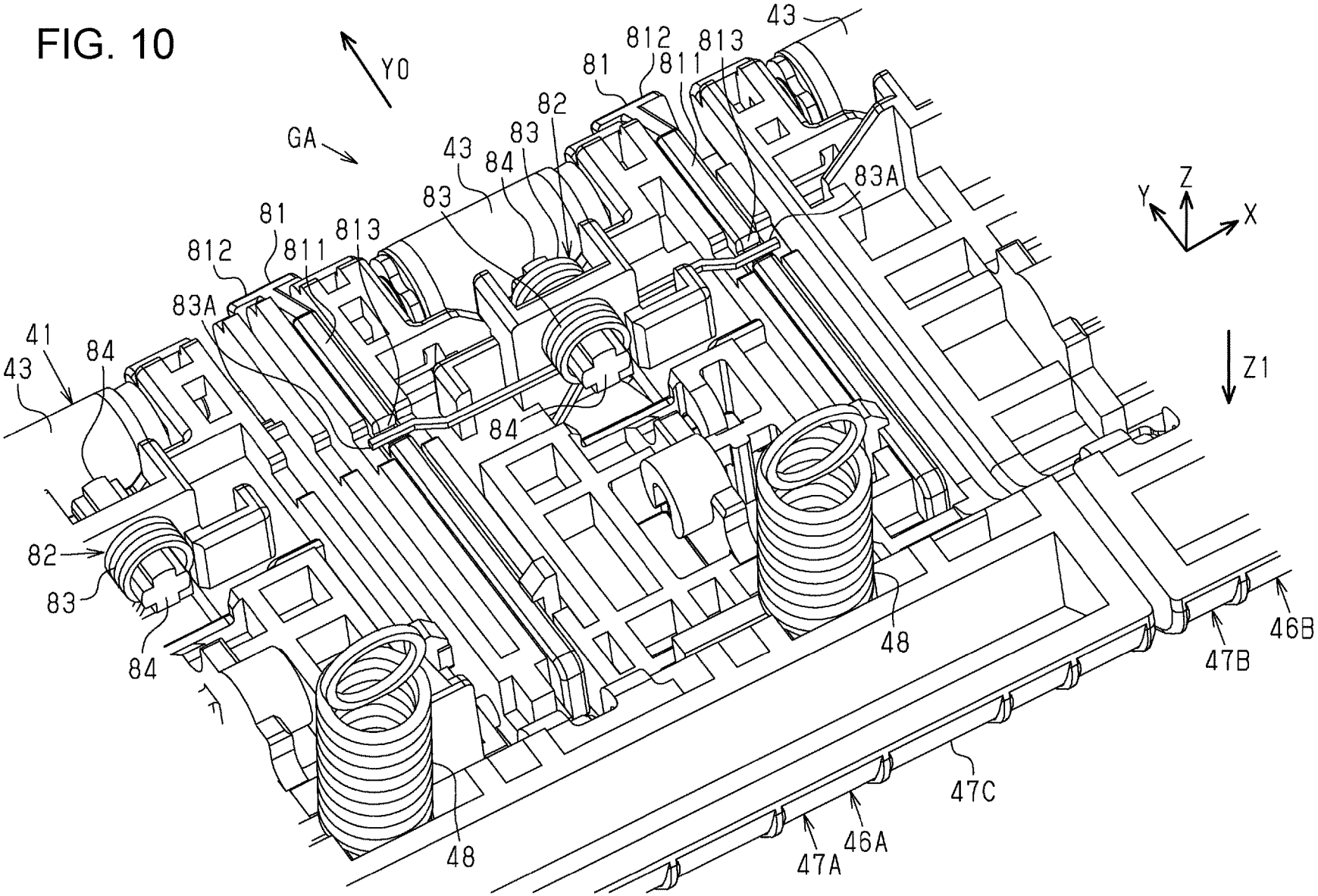
FIG. 10 is an enlarged perspective view illustrating a portion of the medium guiding mechanism.

As illustrated in FIG. 10, the two sides of the biasing mechanism 82 halved in the transport direction Y0 have a 180-degrees rotationally symmetric structure In other words, the biasing mechanism 82 includes a pair of spring support portions 84 that are formed in the first guide member 47A and that have a plane symmetric structure in the transport direction Y0, and two elastic members 83, which are formed of a helical torsion coil spring, mounted on the pair of spring support portions 84. The pair of spring support portions 84 protrude in opposite directions in the transport direction Y0. The two elastic members 83 are mounted in a state in which the two spring support portions 84 are inserted through coil portions thereof. Among two spring legs of each of the two elastic members 83, one is hooked to a predetermined portion of the first guide member 47A, and the other spring legs 83A of the two elastic members 83 extend in opposite directions in the width direction X. An end portion of each of the spring legs 83A is hooked to a recessed portion 813 of an arm 811 of a corresponding one of the two pressing members 81, which are positioned on both sides of the biasing mechanism 82 so as to interpose the biasing mechanism 82 in between in the width direction X, while the end portion presses the arm 811 downwards in the vertical direction Z1. In the present exemplary embodiment, two first guiding mechanisms 46A having such a structure are disposed on both sides of the second guiding mechanism 46B in the width direction X so as to interpose the second guiding mechanism 46B in between; however, in a large recording apparatus 11, by disposing three or more first guiding mechanisms 46A side by side in the width direction X, communization of the parts constituting the medium guiding mechanism 46 can be achieved. Furthermore, a single first guiding mechanism 46A may include a plurality of, or three or more, areas GA with substantially the same structure.

Figure 11:
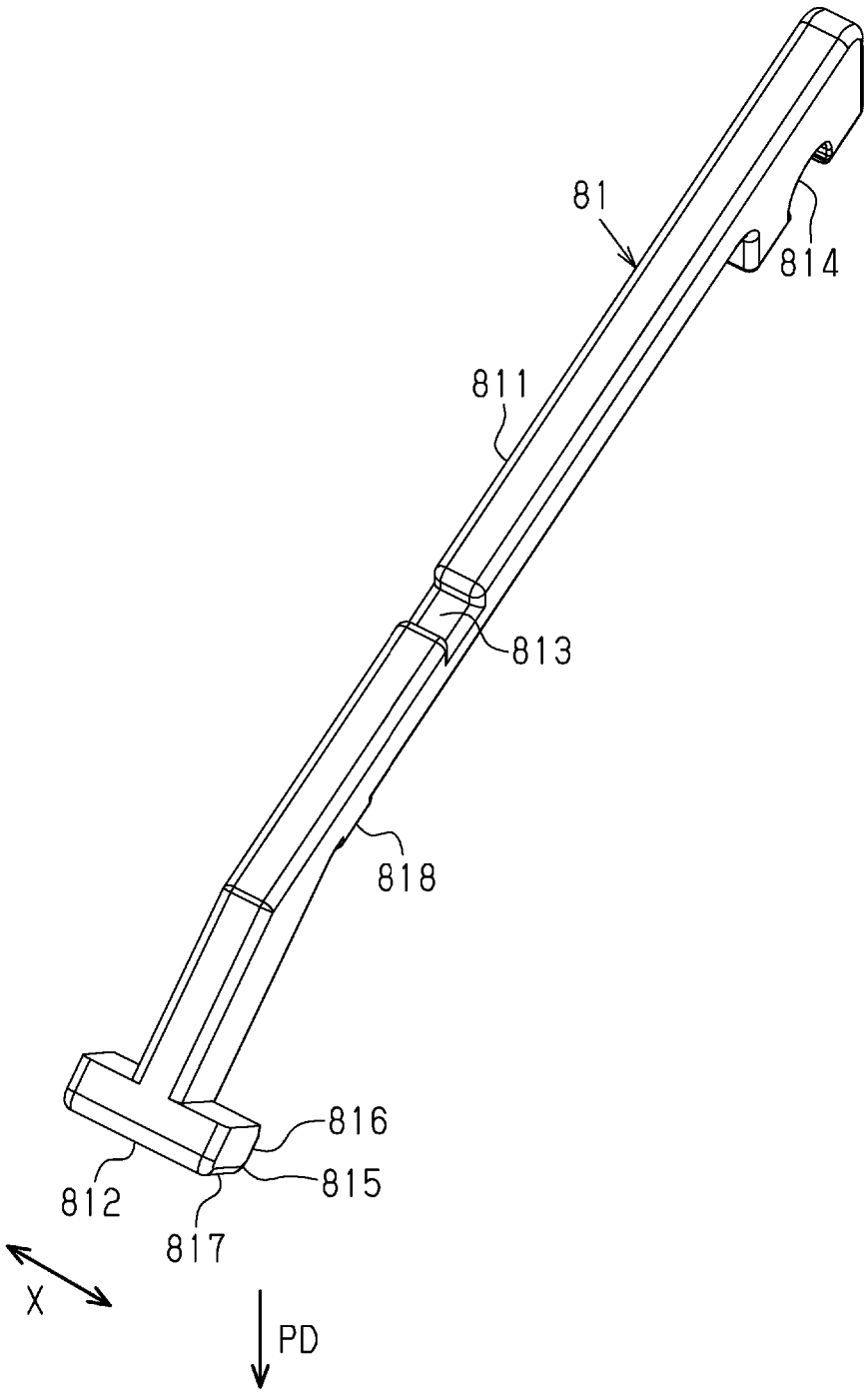
FIG. 11 is a perspective view illustrating a pressing member.

As illustrated in FIG. 11, the pressing member 81 includes an elongated arm 811 and a pressing head 812 protruded at a distal end portion of the arm 811. The arm 811 includes, at a predetermined position in the upper surface thereof, the recessed portion 813 to which an end portion of the spring leg 83A (see FIG. 10) of the elastic member 83 is hooked. The arm 811 includes, in an under surface of a rear end portion thereof, a recessed portion 814 in which the support shaft 471 is mounted on an inner circumferential surface thereof and which is provided with a circular arc-shaped recess. The recessed portion 813 to which the spring is hooked is, in a longitudinal direction of the arm 811, positioned on the distal end side with respect to the recessed portion 814 in which the support shaft is mounted. In the example illustrated in FIG. 11, the recessed portion 813 to which the spring is hooked is, in the longitudinal direction of the arm 811, positioned at a substantially middle portion between the recessed portion 814 in which the support shaft is mounted and the pressing head 812.

The pressing head 812 has a hammer head-shape that protrudes to two sides in the width direction X at the distal end portion of the arm 811. The pressing head 812 includes the abutting portion 815 that abuts against the medium M so that a lower end portion of the pressing head 812 presses down the medium M. In other words, the pressing member 81 includes, at the distal end portion of the arm 811, the abutting portion 815 that abuts against the medium M when pressing down the medium M. The abutting portion 815 has, with respect to the arm 811, a wide shape that protrudes in the width direction X. Inclined surfaces that are inclined against the pressing direction PD is provided on the two sides interposing the abutting portion 815 in the transport direction Y0. The inclined surfaces form a first guiding surface 816 that guides the front end of the medium M to the abutting portion 815, and a second guiding surface 817 that guides the rear end of the medium M to the abutting portion 815. Note that a stopper portion 818 is provided on the under surface of the arm 811 and at a position between the recessed portion 813 to which the spring is hooked and the pressing head 812. When the pressing member 81 is at the standby position illustrated in FIG. 12, the stopper portion 818 abuts against a stopper 472 so as to allow a further movement of the pressing head 812 in the pressing direction PD to be restricted. The stopper 472 is provided in a portion of the guide member 47 corresponding to the stopper portion 818 of the pressing member 81.

Figure 12:
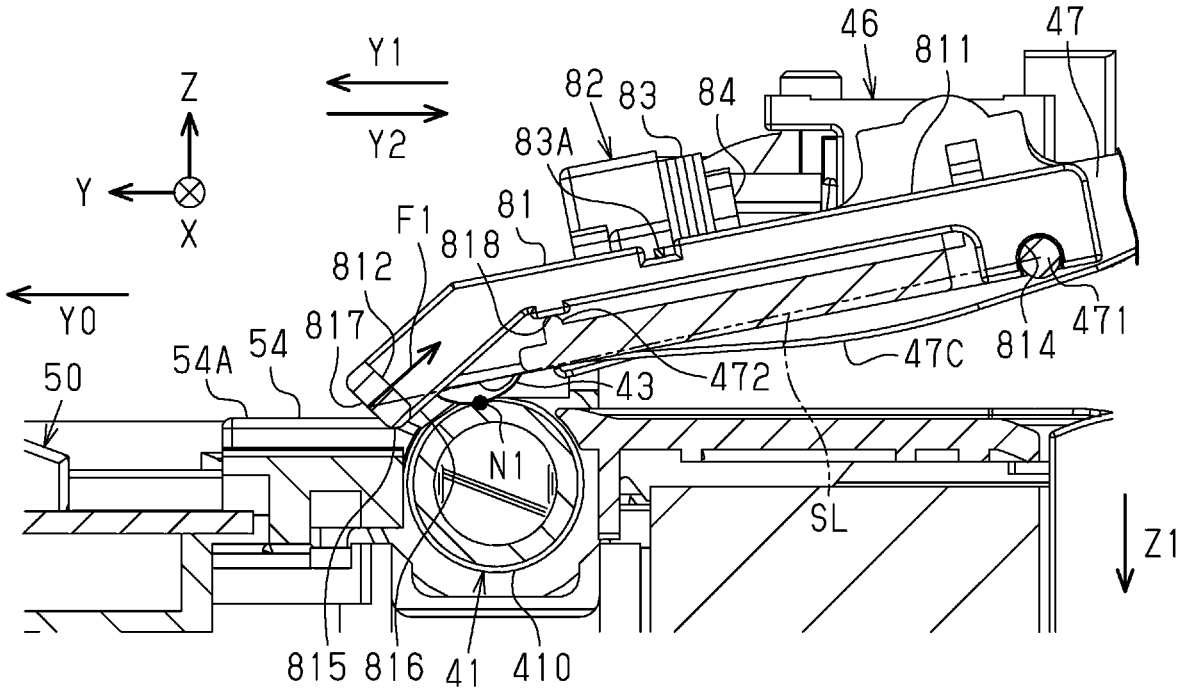
FIG. 12 is a sectional side view illustrating the medium guiding mechanism and the pressing member.

As illustrated in FIG. 12, the pressing member 81 is supported so as to be rotatable about the support shaft 471. The pressing member 81 includes the first guiding surface 816 that guides the front end of the medium M, which is transported in the transport direction Y0, towards the abutting portion 815, and a second guiding surface 817 that guides the rear end of the medium M, which is reverse transported upstream in the transport direction Y0, towards the abutting portion 815. An angle of the first guiding surface 816 when the pressing member 81 is in the standby position illustrated in FIG. 12 is set so that when the front end of the medium M abuts against the first guiding surface 816, the direction of the force that the first guiding surface 816 receives from the medium M is oriented so that the pressing member 81 is pivoted upwards.

An angle of the second guiding surface 817 against the transport direction Y0 when the pressing member 81 is in the standby position illustrated in FIG. 12 is set so that the direction of force F1 that the second guiding surface 817 receives from the medium M when the rear end of the medium M abuts against the second guiding surface 817 is upwards with respect to an imaginary line SL that connects the support shaft 471 serving as the pivot fulcrum and a point at a predetermined position on the second guiding surface 817. In other words, the angle of inclination of the second guiding surface 817 when the pressing member 81 is at the standby position illustrated in FIG. 12 is set so that the direction of the force F1 that the second guiding surface 817 receives from the medium M when the rear end of the medium M abuts against the second guiding surface 817 is a direction that pivots the pressing member 81 upwards.

Figure 13:
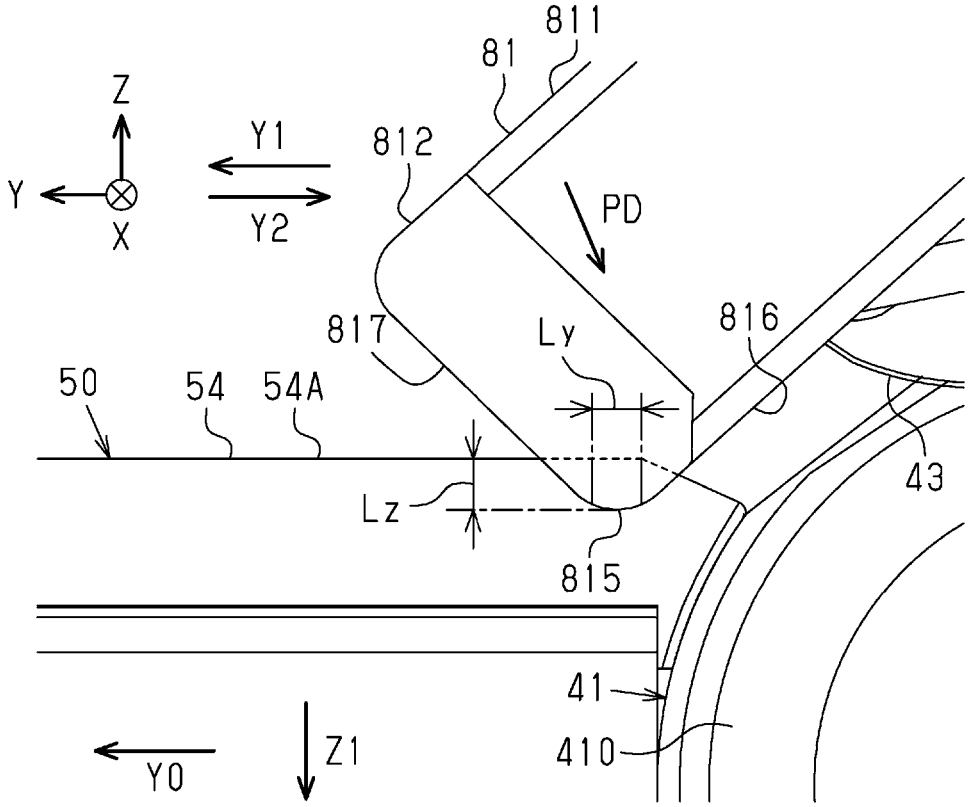
FIG. 13 is a side view illustrating a portion of the pressing member.

As illustrated in FIG. 13, when the pressing member 81 is at the standby position, which is where the pressing member 81 has been moved the most in the pressing direction PD, the abutting portion 815 of the pressing member 81 overlaps the support surface 54A of the rib 54 in the transport direction Y0 by an overlap distance Ly, and overlaps in the vertical direction Z1 that is orthogonal to the support surface 54A by an overlap distance Lz. In other words, in side view illustrated in FIG. 13 viewed in the width direction X that intersects the transport direction Y0, when the pressing member 81 is at the standby position, the abutting portion 815 has a portion that overlaps a portion of the support surface 54A in the rib 54 in both the transport direction Y0 and the vertical direction Z1. In order to satisfy the above overlapping condition, in a medium M that has relatively low rigidity such as, for example, plain paper, the portion in contact with the pressing members 81 is pressed downwards by the pressing members 81. Since the rigidity is low, the medium M becomes flexed and the force lifting the pressing members is relatively small. As a result, as illustrated in FIG. 14, the medium M is curved so as to have a wave shape that is wavy in the width direction X. Such a wave shape that is wavy in the width direction X adds tension to the medium M in the transport direction Y0. With such tension, the medium M becomes less likely to become curved in a direction lifting the front end portion thereof. In other words, lifting of the distal end portion of the medium M is suppressed.

Electric Configuration of Recording Apparatus

The control portion 100 performs various controls including a recording control of the recording apparatus 11. The control portion 100 includes at least one processor that operates according to a computer program (software). The processor includes a CPU, and memories such as RAM and ROM. The memories store program codes or commands that are configured to make the CPU execute processes. The control portion 100 is not limited to one that performs software processing. For example, the control portion 100 may include a dedicated hardware circuit (for example, an application specific integrated circuit or ASIC) that performs hardware processing of at least a portion of the processing that the control portion 100 executes.

The feed motor 35, the transport motor 71, the carriage motor 32, the recording head 25, and the gap adjusting mechanism 37 are, as an output system, electrically coupled to the control portion 100. The control portion 100 controls the feed motor 35, the transport motor 71, the carriage motor 32, the recording head 25, and the gap adjusting mechanism 37. Furthermore, the medium detector 76, the linear encoder 34, and the rotary encoder 74 are, as an input system, electrically coupled to the control portion 100.

The linear encoder 34 includes a linear scale (not shown), and an optical sensor (not shown) provided in the carriage 24. By having the optical sensor optically read the linear scale, a detection signal including the number of pulses proportional to the amount of movement of the carriage 24 is output. Furthermore, the rotary encoder 74 outputs a detection signal including the number of pulses proportional to the rotation amount of each pair of transport rollers 41.

Having the position of the medium M when the front end of the medium M fed from the feed portion 21 is detected by the medium detector 76 to be the position of origin, the control portion 100 counts the value corresponding to the position of the front end or the rear end of the medium M. Based on the counted position of the front end or the rear end of the medium M, the control portion 100 controls the motors 35 and 71 in a transport system, and controls the feeding, transportation, and the discharge of the medium M.

For example, when double-sided recording is instructed, the control portion 100 first drives the transport motor 71 in the normal direction when recording a first surface of the medium M and drives the pairs of transport rollers 41 and the pairs of discharge rollers 42 in the normal direction to transport the medium M in a first transport direction Y1. During the above transportation, an image and the like are recorded on the first surface of the medium M. When ending the recording of the first surface of the medium M, the control portion 100 rotates the transport motor 71 in the reverse direction and drives the pairs of transport rollers 41 and the pairs of discharge rollers 42 in the reverse direction to transport the medium M in a reversed manner in the second transport direction Y2. The medium M transported in the reversed manner passes through an inversion path (not shown) to invert the medium M so that a second surface on the side opposite the first surface becomes the recorded surface subject to recording, and the inverted medium M is fed in the first transport direction Y1 once again. As described above, when double-sided recording is performed, the control portion 100 drives the transport motor 71 in the normal direction and transports the medium M in the first transport direction Y1 to have the recording portion 23 perform recording on the first surface, and drives the transport motor 71 in the reverse direction after the recording on the first surface has ended and reverse transports the medium M in the second transport direction Y2 to invert the medium M. Subsequently, the recording portion 23 performs recording on the second surface of the medium M that has been fed once more in the first transport direction Y1. The medium M on which double-sided recording has been performed is discharged through the discharge opening 75 and is mounted on the stacker 27.

The control portion 100 acquires the position of the carriage in the scanning direction X, in which the position of origin of the carriage 24 serves as the reference, by counting the number of pulse edges of the detection signal input from the linear encoder 34 that sets the origin as the time at which the point of origin has been reached with the carriage 24 coming in contact with an end position on the home position HP side. Based on an enumerated data of the position of the carriage, the control portion 100 controls the carriage motor 32 to perform speed control and position control of the carriage 24.

The control portion 100 stores the current gap in one of the memories. Furthermore, reference data that shows the correspondence between the type of medium and the gap is stored in the memory. When the control portion 100 receives the recording data, the control portion 100 acquires information on the type of medium included in the recording data. Based on the acquired information on the type of medium, the control portion 100 acquires the gap that is to be set. When performing gap control that adjusts the gap to the gap that is to be set, the control portion 100 controls the carriage 24 and makes the carriage 24 perform gap switching control. A gap between a nozzle surface 25A of the recording head 25 and the ribs 54 and 55 of the support member 50 is adjusted to a target gap.

An action of the recording apparatus 11 will be described next.

For example, when double-sided recording is performed, the medium M fed by the feed portion 21 is, as illustrated in FIG. 6, transported in the first transport direction Y1 with the pairs of transport rollers 41. The medium M that has passed through the pairs of transport rollers 41 abuts against the abutting portions 815 of the pressing members 81 and is pushed downwards. A front end of a medium M with low rigidity such as plain paper or the like is guided along the first guiding surfaces 816, illustrated in FIG. 13, to the abutting portions 815. The medium M with low rigidity is pressed down at a plurality of portions in the width direction X with the plurality of pressing members 81. Since the plurality of pressing members 81 are disposed in the width direction X at positions corresponding to the recessed areas 59 where there are no ribs 54, the medium M is pressed down at the plurality of portions spaced apart in the width direction X.

As illustrated in FIG. 13, the abutting portion 815 of each pressing member 81 overlaps the support surface 54A of the corresponding rib 54 in the transport direction Y0 by the overlap distance Ly and overlaps the support surface 54A of the corresponding rib 54 in the vertical direction Z1 by the overlap distance Lz. Accordingly, a medium M with a low rigidity such as plain paper or the like becomes flexed at portions that are pressed down by the pressing members 81 and, as illustrated in FIG. 14, the medium M becomes curved so as to have a wave shape that is wavy in the width direction X. The wave shape that is wavy in the width direction X adds tension to the medium M in the transport direction Y0. Due to the above tension, the front end portion of the medium M is less likely to become curved in the lifting direction. As a result, lifting of the front end portion of the medium M is suppressed.

For example, when the front end portion of the medium M becomes lifted, the front end portion may come in contact with the recording head 25. When the front end portion of the medium M comes in contact with the nozzle surface 25A of the recording head 25, the medium M becomes stained with ink. Furthermore, when the front end portion of the medium M becomes lifted, the recording head 25 moving in the width direction X comes in contact with the front end portion of the medium M and due to such contact, jamming of the medium M occurs. Conversely, in the present exemplary embodiment, lifting of the front end portion of the medium M is suppressed; accordingly, staining and jamming of the medium M due to the front end portion of the medium M coming in contact with the nozzle surface 25A of the recording head 25 can be prevented.

Furthermore, regarding a medium M such as, for example, photographic paper that has a relatively high rigidity, the front end thereof abuts against the first guiding surfaces 816, which lifts the pressing heads 812. As a result, the pressing members 81 countering the biasing force of the elastic members 83 become lifted; accordingly, the surface of the medium M, such as photographic paper that has a high rigidity, does not become damaged. As a result, a high definition image is recorded on the photographic paper.

Incidentally, during double-sided recording, when recording on the first surface has ended, the medium M is reverse transported in the second transport direction Y2. The rear end of the medium M transported in the second transport direction Y2 abuts against the second guiding surface 817 illustrated in FIG. 13. For example, in a medium M that has low rigidity such as plain paper, the portion in contact with the pressing members 81 is pressed downwards by the pressing members 81. Since the rigidity is low, the medium M becomes flexed and the force lifting the pressing members 81 is relatively small. As a result, as illustrated in FIG. 14, the medium M is curved so as to have a wave shape that is wavy in the width direction X. Such a wave shape that is wavy in the width direction X adds tension to the medium M in the transport direction Y0. With such tension, the medium M becomes less likely to become curved in a direction lifting the rear end portion thereof. In other words, lifting of the rear end of the medium M is suppressed.

Regarding a medium M such as, for example, photographic paper that has a relatively high rigidity, by having the front end thereof abut against the second guiding surfaces 817, the pressing members 81 lift the pressing heads 812 about the support shafts 471. As a result, the medium M reverse transported in the second transport direction Y2 is smoothly reverse transported without being caught by the pressing members 81. In so doing, the recorded surface on which recording has been performed is less likely to become damaged.

Subsequently, the inverted medium M is fed once more in the first transport direction Y1. In a medium M that has low rigidity such as, for example, plain paper, the wave shape is formed by the pressing members 81 in a manner similar to that when recording is performed on the first surface. Accordingly, lifting of the front end portion of the medium M is suppressed in a manner similar to when recording is performed on the first surface. Furthermore, regarding a medium M such as, for example, photographic paper that has high rigidity, the pressing members 81 are lifted in a manner similar to when recording is performed on the first surface; accordingly, the surface of the medium M is less likely to become damaged. Accordingly, a high definition image is recorded on the second surface of the photographic paper as well.

The following effects can be obtained with the first exemplary embodiment described above.

(1) The recording apparatus 11 includes the support member 50 that includes the support surfaces 54A that support the portions of the medium M on which the recording portion 23 performs recording, and pressing members 81 that press the medium M towards the support member 50 at positions upstream of the recording position of the recording portion 23 in the transport direction Y0. The pressing members 81 are provided so as to be movable in the direction intersecting the support surfaces 54A. Accordingly, lifting of the medium M can be suppressed by the pressing members 81 pressing down the medium M, and the medium M coming in contact with the recording portion 23 due to being lifted can be reduced. Furthermore, since the pre-printing positions of the medium M upstream of the recording position in the transport direction Y0 are pressed down, the recorded image does not become damaged. Furthermore, since contamination such as recording ink is not transferred to the pressing members 81, the contamination transferred to the pressing members 81 being transferred to the other mediums M and staining the other mediums M can be prevented. Furthermore, since the pressing members 81 are movable in the direction intersecting the support surfaces 54A, when the medium M has high rigidity, for example, the medium M is less likely to become damaged when the pressing members 81 are retracted in a direction away from the support surfaces 54A.

(2) The recording apparatus 11 includes elastic members 83 that bias the pressing members 81 in the pressing direction PD that is a direction approaching the support member 50. Accordingly, since the pressing members 81 that are provided so as to be movable in the direction intersecting the support surfaces 54A are biased in the pressing direction PD, when the medium M has high rigidity, for example, the medium M is less likely to become damaged when the pressing members 81 are retracted in a direction away from the support surfaces 54A.

(3) The transport portion 40 includes the pairs of transport rollers 41, each pair being formed by the driving roller 410 and the driven roller 43. The transport portion 40 includes the guide member 47 that is pivotably supported while supporting the driven rollers 43 at the downstream end portion in the transport direction Y0, and the biasing members 48 that bias the guide member 47 in the direction in which the driven rollers 43 approach the driving roller 410. The pressing members 81 are provided at the downstream end portions of the guide member 47 in the transport direction Y0 while being biased in the pressing direction PD with the elastic members 83. Accordingly, the pressing members 81 can be disposed at positions corresponding to the ribs 54 of the support member 50 by using the guide member 47 that supports the driven rollers 43.

(4) The pressing members 81 include abutting portions 815 that abut against the medium M when pressing down the medium M, and the first guiding surfaces 816 that guide the front end of the medium M, which is transported in the transport direction Y0, to the abutting portions 815. Accordingly, even when the front end portion of the medium M transported in the transport direction Y0 is lifted, the front end portion is guided along the first guiding surfaces 816 of the pressing members 81 to the abutting portions 815. Accordingly, the front end portion of the medium M being lifted and coming in contact with the recording portion 23 can be suppressed. Furthermore, in a configuration in which the abutting portions 815 are positioned below the support surfaces 54A in the vertical direction Z1, which is a direction extending away from the nozzle surface 25A, and in which the abutting portions 815 overlap the ribs 54 in the vertical direction Z1, the abutting portions 815 are positioned farther away from the nozzle surface 25A than the nip positions N1. In such a case, the front end of the medium M with low rigidity such as plain paper or the like moved along the first guiding surfaces 816 is guided to the abutting portions 815, and the medium M can be curved so as to have a wave shape. Furthermore, the front end of the medium M with high rigidity such as photographic paper or the like moved along the first guiding surfaces 816 lifts the abutting portions 815; accordingly, the medium M is less likely to become damaged.

(5) The pressing members 81 include the second guiding surfaces 817 that guide the rear end of the medium M, which is reverse transported upstream in the transport direction Y0, towards the abutting portions 815. Accordingly, even when the rear end portion of the medium M that is reverse transported is lifted, the rear end portion is guided along the second guiding surfaces 817 of the pressing members 81 to the abutting portions 815. Accordingly, even when the rear end of the medium M that is reverse transported becomes lifted, the medium M can be smoothly reverse transported.

(6) The second guiding surface 817 is set at an angle so that an upward direction orthogonal to the second guiding surface 817 at the predetermined position is above the imaginary line SL connecting the predetermined position on the second guiding surface 817 and the support shaft 471 serving as the pivot fulcrum. Accordingly, by moving the rear end of the medium M, which is reverse transported, with a high rigidity along the second guiding surfaces 817, the pressing members 81 can be lifted. Furthermore, by moving the rear end of the medium M, which is reverse transported, with a low rigidity along the second guiding surfaces 817, the rear end of the medium M can be guided to the abutting portions. Accordingly, the medium M can be smoothly reverse transported. Furthermore, since the recording portion 23 is positioned in the area downstream of the abutting portions 815 in the transport direction Y0 when the recording portion 23 is performing recording, a space to dispose the pressing members 81 cannot easily be obtained therein. In the pressing members 81, since the support shafts 471 serving as pivot fulcrums are disposed at positions that are upstream of the abutting portions 815 in the transport direction Y0, the spaces to dispose the pressing members 81 can be obtained easily.

(7) The support member 50 includes the plurality of ribs 54 including, on end surfaces thereof, support surfaces 54A that are positioned at intervals in the width direction X, and the plurality of recessed areas 59 that are areas in the support member 50 other than the plurality of ribs 54 and that are areas that are lower in height than the ribs 54. The abutting portions 815 of the pressing members 81 are disposed at positions opposing the recessed areas 59 of the support member 50. Accordingly, contact between the pressing members 81 and the ribs 54 can be prevented. For example, when the ribs 54 are stained with ink and the like, the contamination is transferred to the pressing members 81 that have come in contact with the ribs 54 and, subsequently, the contamination is transferred to the medium M from the pressing members 81. The medium M can be prevented from becoming stained due to the above type of cause. Furthermore, the medium M can be pressed deeper down with respect to the support surfaces 54A of the ribs 54. For example, the medium M can be curved into a wave shape.

(8) When the pressing members 81 are positioned at where the pressing members 81 have been moved the most in the pressing direction PD, the abutting portions 815 overlap the support surfaces 54A of the ribs 54 in the vertical direction Z1, which is orthogonal to the support surfaces 54A, and in the transport direction Y0. Accordingly, by having the plurality of pressing members 81 press down deep, with respect to the support surfaces 54A of the ribs 54, the portions of the medium M that correspond to the recessed areas 59, the medium M can be made to curve into a wave shape. Accordingly, contact between the transported medium M and the recording portion 23 can be reduced.

(9) The pressing members 81 are, at the least, provided at positions between the outermost ribs 54 that support the two edge portions of the medium M, which has the largest width, in the width direction X, and the ribs 54 positioned next to and inside the outermost ribs 54 in the width direction X. Accordingly, since the waves can be formed at the end portions of the medium M, which are portions where the waves can be formed easily, appropriate-sized waves can be formed reliably in the medium M without excessively loading the medium M, and the lifting of the transported medium M from the support surfaces can be suppressed. Note that compared with pressing down the end portions of the medium M in the width direction X, the middle portion of the medium M in the width direction X is not easily flexed when the medium M is pressed down. The medium M is flexed more easily and formation of waves is easier at portions near the end portions, which are free ends.

(10) The pressing members 81 include the arms 811 and, at the distal end portion of the arms 811, the abutting portions 815 that abut against the medium M when pressing down the medium M. The abutting portion 815 has a wide shape that protrudes in the width direction X. Accordingly, compared with a configuration in which the dimension of the abutting portion of the pressing member 81 in the width direction is the same as that of the arm, a wider portion of the medium M can be pressed down. For example, the medium M can be curved into an appropriate wave shape without creating small folds and indentations such as scratches in the medium M.

(11) For example, when the pressing member 81 is fixed to a frame or the like that cannot be deformed together with the medium guiding mechanism 46, the amount of pressing of the pressing member 81 becomes larger as the medium M becomes thicker; accordingly, thick mediums M are more likely to become damaged. Conversely, since the pressing members 81 are provided in the medium guiding mechanism 46, the medium guiding mechanism 46 becomes displaced upwards according to the thickness of the medium M nipped by the pairs of transport rollers 41. Accordingly, the amount of pressing with the pressing members 81 into the surface of the medium M becomes uniform regardless of the thickness of the medium M. Accordingly, compared with a configuration in which the pressing members 81 are fixed to a frame and the like, thick mediums M such as photographic paper and the like are not likely to become damaged.

Second Exemplary Embodiment

A description of a second exemplary embodiment will be given next. In the second exemplary embodiment, the shape of the pressing head at the distal end portion of the pressing member is different from that of the first exemplary embodiment. Referring hereinafter to FIGS. 15 to 23, the second exemplary embodiment will be described. The positions where the pressing members 81 are disposed in the second exemplary embodiment are basically similar to those of the first exemplary embodiment described above. The pressing members 81 are provided so as to be movable in the direction intersecting the support surfaces 54A of the support member 50. The pressing members 81 of the present example are also biased in the pressing direction PD with the biasing force of the elastic members 83. Similar to the first exemplary embodiment described above, in the pressing members 81 of the present example, by being pivoted, the abutting portions 815 at the distal end portions of the pressing members 81 press down the medium M in the pressing direction PD (see FIG. 16).

Figure 15:
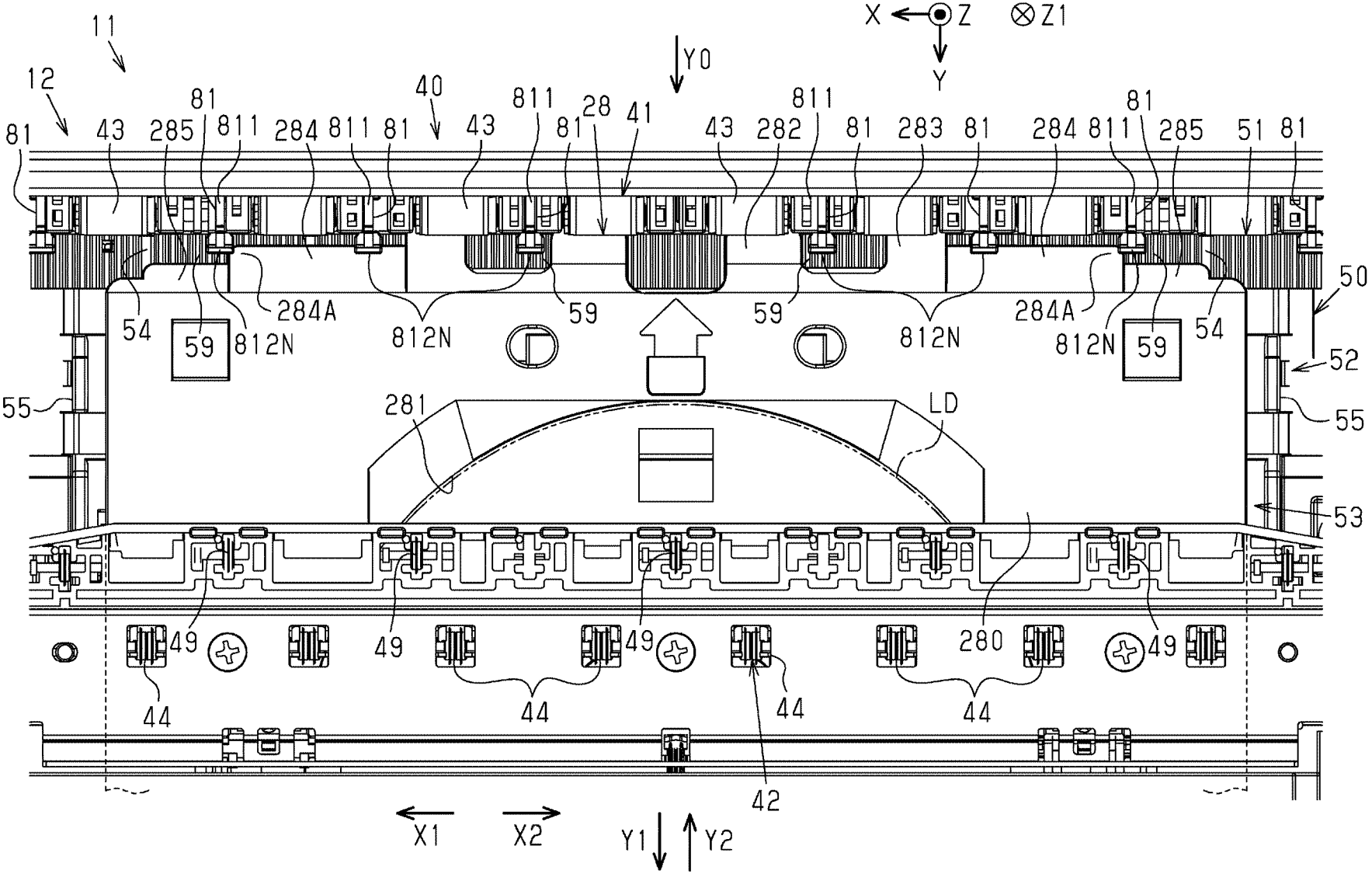
FIG. 15 is a plan view illustrating a portion of the transport portion and a process of the disk tray being inserted in the second exemplary embodiment.

As illustrated in FIG. 15, the plurality of pressing members 81 are disposed with a gap in between each other in the width direction X while pressing heads 812N are positioned at positions above the first support portion 51 that constitutes the support member 50. The pressing heads 812N are positioned so as to correspond to the recessed areas 59 between the ribs 54 in the width direction X.

The pressing members 81 illustrated in FIG. 15 are provided so as to be pivotable about the support shafts 471 (see FIG. 12). When there is no medium M that is the target to be pressed down is not present under the abutting portions 815 of the pressing members 81, the abutting portions 815 are pivoted to the lower limit thereof with the biasing force of the elastic members 83 (see FIGS. 9 and 10) and are positioned at a height below the support surfaces 54A of the ribs 54. Accordingly, the pressing members 81 press down the medium M, which is supported by the support surfaces 54A, from above at positions of the recessed areas 59 between the ribs 54 in the width direction X to positions below the support surfaces 54A.

One of the features of the pressing members 81 of the present exemplary embodiment is that an issue of interference between a disk tray 28 and pressing members 81 when setting the disk tray 28, on which the disk LD is set, in the recording apparatus 11 is overcome when performing label recording on a disk LD such as a CDR, DVD, or the like. In the present example, the shape of the pressing heads 812N of the pressing members 81 is devised to resolve the issue described above that occurs when the shape of pressing heads 812 of the pressing members 81 is that of the first exemplary embodiment. FIG. 15 illustrates a state during a process of the disk tray 28 on which the disk LD is set being inserted from near the discharge opening 75 (see FIG. 4) open towards the front of the recording apparatus 11 into the apparatus body 12 along the guide on the upper surface of the stacker 27 when label recording is performed. Note that inserting of the disk tray 28 into the apparatus body 12 may be performed manually by the user or may be performed automatically through motive power of an actuator such as a motor (not shown).

The disk tray 28 includes a square-plate shaped body 280 including a circular set portion 281 on which the disk LD can be set, and an extension portion 282 that extends to a front end portion of the body 280 in an insertion direction relative to the apparatus body 12.

As illustrated in FIG. 15, in the course of the disk tray 28 on which the disk LD has been set being inserted into the apparatus body 12, the extension portion 282 is nipped by the pairs of transport rollers 41 constituting the transport portion 40. While the extension portion 282 is nipped by the pairs of transport rollers 41, the disk tray 28 is inserted in the second transport direction Y2 to a predetermined recording start position. When the disk LD is, together with the disk tray 28, inserted to the predetermined recording start position, recording on the label surface of the disk LD is started from the above recording start position. During the recording, the disk tray 28 is transported in the first transport direction Y1 with the pairs of transport rollers 41 and the pairs of discharge rollers 42. In the course of the above transportation, label recording that performs recording on the label surface of the disk LD is performed by ejecting a liquid with the recording head 25.

As illustrated in FIG. 15, the extension portion 282 of the disk tray 28 is formed of a plate-like shape that facilitates nipping of the pairs of transport rollers 41. The extension portion 282 is formed of a plurality of extension portions 283 to 285 and the like, which have different extension lengths. If the extension portion 282 were to have a simple square-plate shape in which the extension length is uniform regardless of the position in the width direction X, the entire width area of the extension portion 282 will be nipped by the pairs of transport rollers 41 at the same time; accordingly, the load in lifting the plurality of driven rollers 43 will be extremely large. In such a case, the load when the user pushes the disk tray 28 to set the disk tray 28 becomes excessively large, or the load on the motor or the like, which is a drive source, when automatically inserting the disk tray 28 will become excessively large.

Accordingly, in the present exemplary embodiment, the extension portion 282 of the disk tray 28 is configured of the plurality of extension portions 283 to 285 that have different extension lengths so that the extension portion 282 is nipped by the pairs of transport rollers 41 in a stepwise manner. In other words, the extension portion 282 includes a first extension portion 283, second extension portions 284, third extension portions 285, and the like that have different extension lengths. The first extension portion 283 is positioned at the middle portion in the width direction X and has the largest extension length. The pair of second extension portions 284 are positioned on both sides of the first extension portion 283 in the width direction X and have extension lengths that are shorter than that of the first extension portion 283. The pair of third extension portions 285 are positioned outside the pair of second extension portion 284 in the width direction X and have extension lengths that are shorter than that of the second extension portion 284. Note that the first extension portion 283 includes a plurality of recessed portions at different positions in the width direction X. The positions of the plurality of extension portions 283 to 285 in the width direction X are positioned so as to generally correspond to the plurality of driven rollers 43. When the disk tray 28 is inserted into the apparatus body 12, first, the first extension portion 283 is nipped by the pairs of transport rollers 41. Subsequently, the second extension portions 284 are nipped by the pairs of transport rollers 41. Lastly, the third extension portions 285 are nipped by the pairs of transport rollers 41. Due to the above, the load when the disk tray 28 is inserted to the recording start position is reduced.

Since the extension portions 283 to 285 are formed of shapes in which the extension lengths are different in a stepwise manner, the extension portions 283 to 285 include corner portions at the outer edge portions in the width direction X. During the insertion of the disk tray 28, corner portions 284A of the second extension portions 284 are at positions that can be in contact with the pressing heads 812N of two pressing members 81. Outer circumferential surfaces of the corner portions 284A of the present example are formed in a circular arc shape. Accordingly, when the pressing heads 812N of the two pressing members 81 come in contact with the circular arc-shaped outer circumferential surfaces of the two corner portions 284A and as the insertion of the disk tray 28 proceeds, the pressing heads 812N are pushed to the outside in the width direction X along the outer circumferential surfaces of the corner portions 284A. In FIG. 15, regarding the two pressing members 81 at the positions corresponding to the two corner portions 284A, the one on the left side is pushed in a first direction X1, and the other one on the right side is pushed in a second direction X2.

Figure 16:
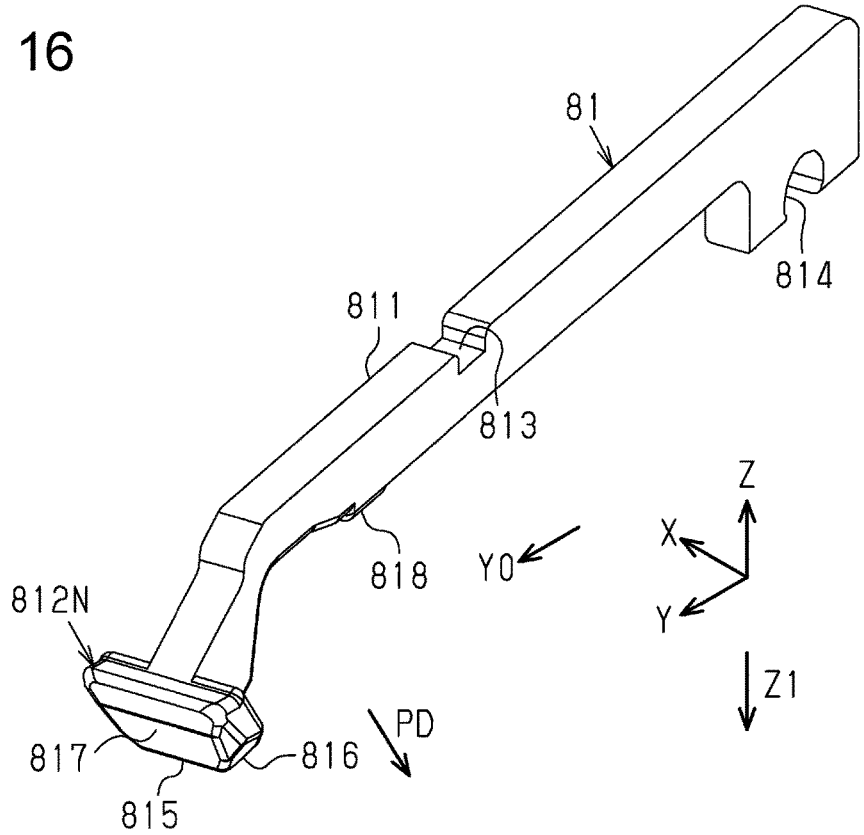
FIG. 16 is a perspective view illustrating a pressing member of the second exemplary embodiment.

FIG. 16 illustrates the entire pressing member 81 of the second exemplary embodiment. As illustrated in FIG. 16, the pressing member 81 of the second exemplary embodiment includes the arm 811, and the pressing head 812N provided so as to protrude at the distal end portion of the arm 811 in the transport direction Y0. A shape of the pressing head 812N is different from that of the pressing head 812 of the first exemplary embodiment described above. Similar to the first exemplary embodiment described above, the pressing head 812N has a protruded shape protruded, with respect to the arm 811, on both sides in the width direction X. The pressing head 812N includes the first guiding surface 816 and the second guiding surface 817. Note that similar to the first exemplary embodiment, the arm 811 includes the recessed portion 813 to which the spring leg 83A of the elastic member 83 is hooked, the recessed portion 814 in which the support shaft 471 is inserted, and the stopper portion 818 configured to abut against the stopper 472.

Figure 17:
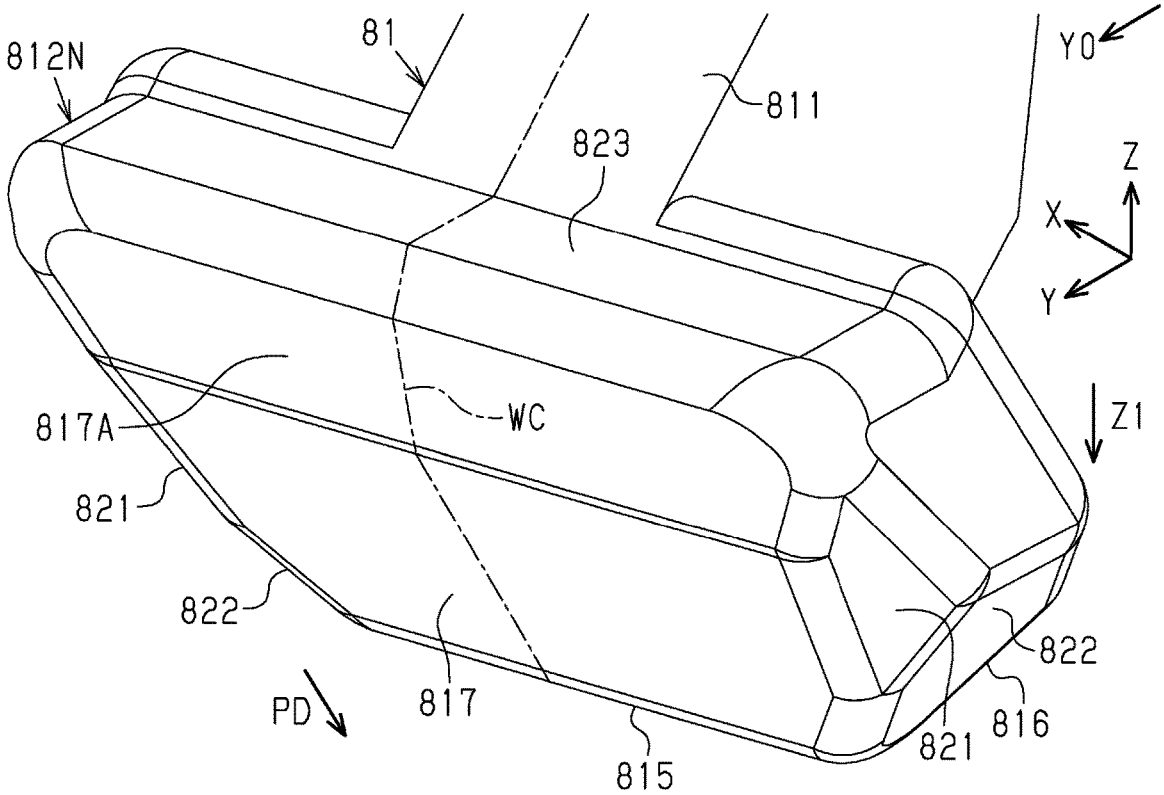
FIG. 17 is an enlarged perspective view illustrating a pressing head of the pressing member.

As illustrated in FIG. 17, the pressing head 812 has, with respect to a width center WC, a shape symmetrical in the width direction X The pressing head 812N includes a first surface 817A, second surfaces 821, and third surfaces 822 that are not present in the pressing head 812 of the first exemplary embodiment described above.

The pressing member 81 includes the first surface 817A at a position above and adjacent to the second guiding surface 817. The first surface 817A is inclined in the same direction as that of the second guiding surface 817. In the present exemplary embodiment, an angle of the first surface 817A against a horizontal plane is larger than an angle of the second guiding surface 817 against a horizontal plane. The above is set for obtaining the gap required to prevent contact between the pressing head 812N and the recording portion 23 by separating the position of the upper end of the first surface 817A as far as possible to a portion upstream in the transport direction Y0. Note that the angles of the first surface 817A and the second guiding surfaces 817 may be the same.

Figure 22:
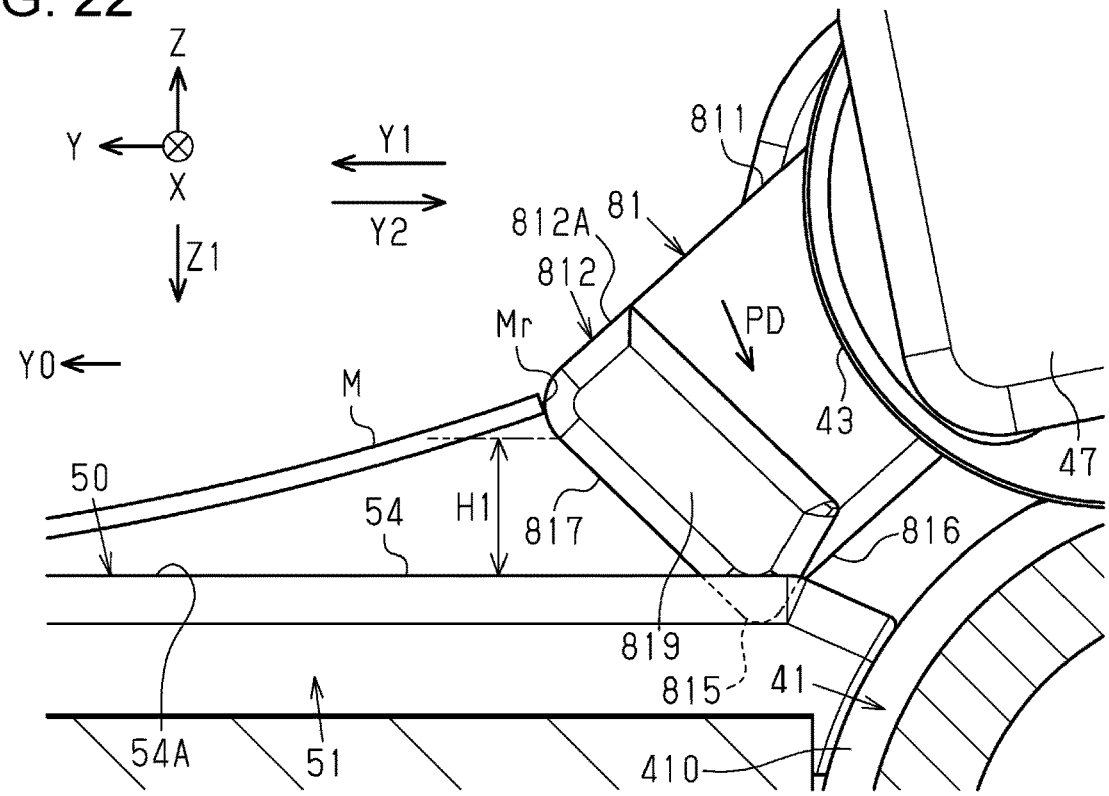
FIG. 22 is a side view illustrating an issue of the pressing member of the first exemplary embodiment when the medium is reverse transported during double-sided recording.
Figure 23:
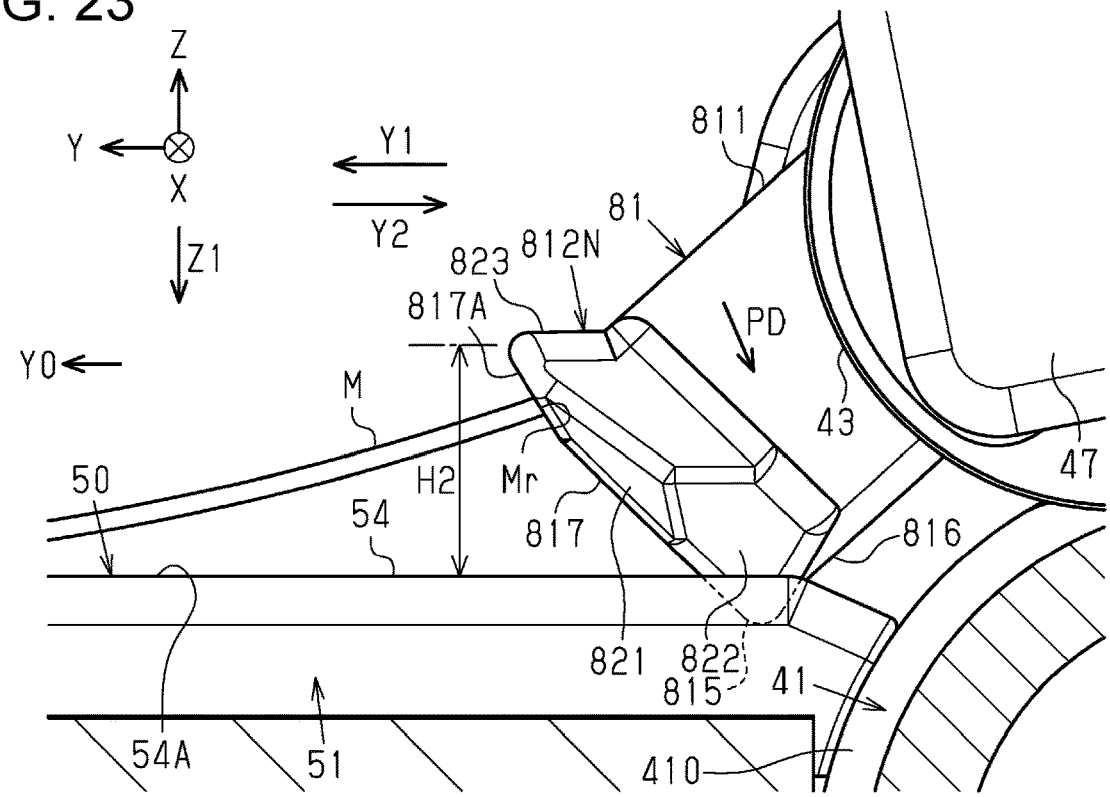
FIG. 23 is a side view illustrating an action of the pressing member of the second exemplary embodiment when the medium is reverse transported during double-sided recording.

The pressing head 812 of the pressing member 81 of the first exemplary embodiment illustrated in FIG. 22 and the pressing head 812N of the pressing member 81 of the second exemplary embodiment illustrated in FIG. 23 will be compared. In the pressing head 812 of the first exemplary embodiment, an upper surface 812A above and adjacent to the second guiding surface 817 is an inclined surface that is inclined downwards as the upper surface 812A extends downstream in the transport direction Y0. The angle of the upper surface 812A against the horizontal plane is, for example, a predetermined angle that is 30 degrees or more. Accordingly, a height dimension H1 of the second guiding surface 817 in the vertical direction Z1 is relatively small.

On the other hand, as illustrated in FIG. 23, an upper surface 823 of the pressing head 812N of the pressing member 81 of the second exemplary embodiment extends in a substantially horizontal manner. The upper surface 823 may be an inclined surface that is inclined downwards as the upper surface 823 extends downstream in the transport direction Y0. In such a case, the angle of the upper surface 823 against the horizontal surface is, for example, under 20 degrees. Accordingly, the first surface 817A that is above and adjacent to the second guiding surface 817 and that is a surface that is inclined in the same direction as that of the second guiding surface 817 is added between the second guiding surface 817 and the upper surface 823. With the addition of the first surface 817A, a height dimension H2 of the guiding surface, which is the combination of the second guiding surface 817 and the first surface 817A, in the vertical direction Z1 is larger than the height dimension H1 of the second guiding surface 817 in FIG. 22. Note that the upper surface 823 of the pressing head 812N may be a surface that is inclined upwards with respect to the horizontal plane.

Furthermore, as illustrated in FIG. 17, the pressing member 81 includes a pair of second surfaces 821 on both sides of the pressing head 812N in the width direction X with the width center WC in between. The second surface 821 is an inclined surface that is formed across an area in height including the height position at which the disk tray 28 comes in contact with the corner portions 284A of the extension portion 282 nipped by the pairs of transport rollers 41, and is an inclined surface that is inclined in a direction that approaches the width center WC as the second surface 821 extends downwards and downstream in the transport direction Y0 (the first transport direction Y1).

Furthermore, as illustrated in FIG. 17, the pressing member 81 includes the pair of third surfaces 822 in the lateral surface on both sides of the pressing head 812N in the width direction X with the width center WC in between. The third surface 822 is positioned on the lateral surface that is a surface that is adjacent to the first guiding surface 816 in the width direction X and that intersects the width direction X. The third surface 822 is a surface that is formed across an area in height including the height position when the medium M is transported and is a surface that is inclined in a direction approaching the width center WC of the pressing member 81 as the third surface 822 extends downwards. Note that the "area in height including the height position" that specifies the positions where the second surface 821 and the third surface 822 are formed is set based on the state in which the pressing member 81 is at the standby position.

An action of the pressing member 81 of the second exemplary embodiment configured in a manner described above will be described next while making a comparison with the pressing member 81 of the first exemplary embodiment.

An action when inserting the disk tray 28 into the apparatus body 12 will be described first.

Figure 18:
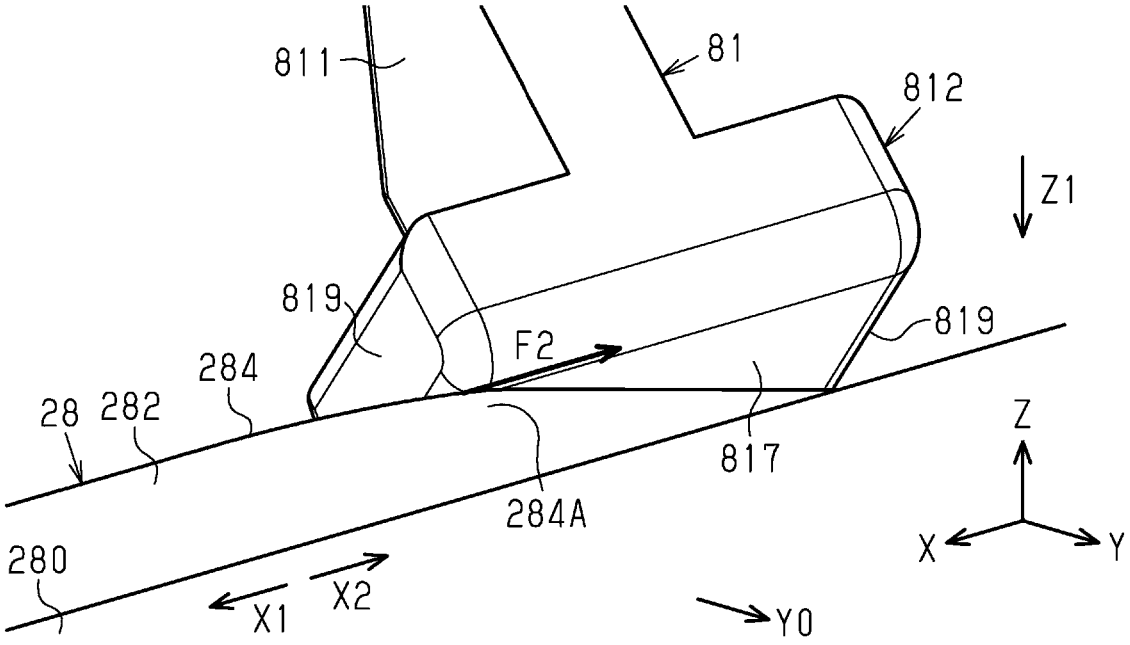
FIG. 18 is a perspective view illustrating an issue of the pressing member that is created when the disk tray is inserted into the recording apparatus of the first exemplary embodiment.

As illustrated in FIG. 18, in the pressing member 81 of the first exemplary embodiment, in the course of inserting the disk tray 28 in the second transport direction Y2, an outer circumferential surface of the corner portion 284A comes in contact with a lateral surface 819 of the pressing head 812 and the pressing head 812 receives force F2 in the width direction X. Accordingly, an unreasonable force that is different from a pivoting direction of the pressing member 81 is applied to the pressing member 81.

Figure 19:
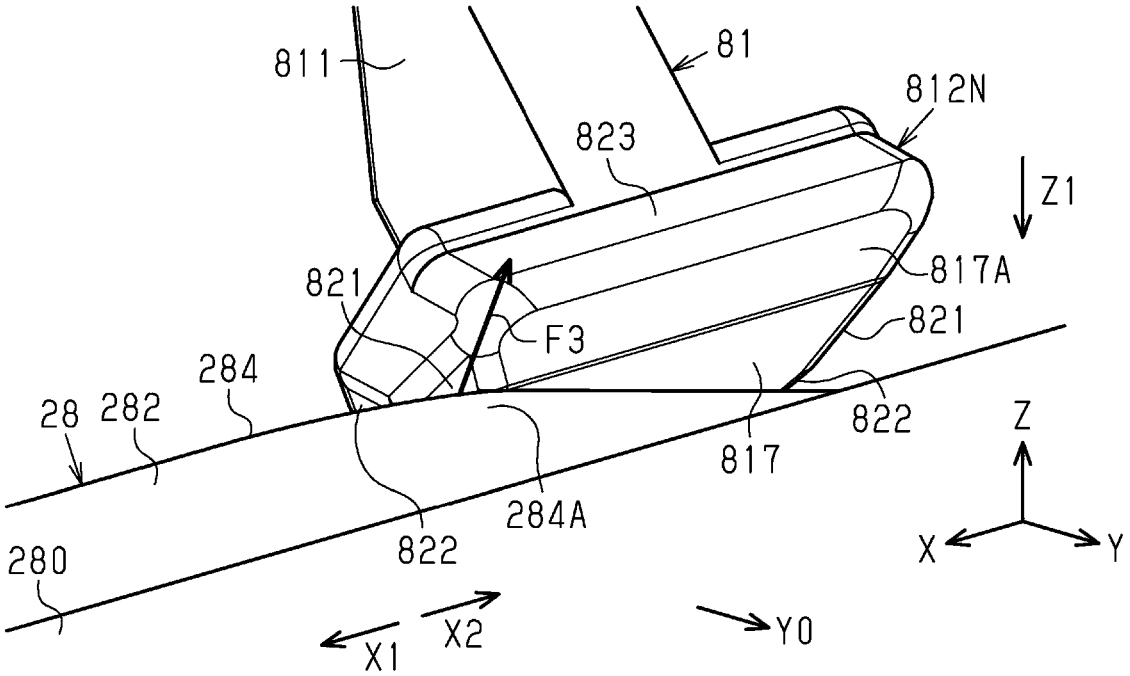
FIG. 19 is a perspective view illustrating an action of the pressing member of the second exemplary embodiment when the disk tray is inserted.

On the other hand, as illustrated in FIG. 19, in the pressing member 81 of the second exemplary embodiment, in the course of inserting the disk tray 28 in the second transport direction Y2, an outer circumferential surface of the corner portion 284A comes in contact with the second surface 821 of the pressing head 812N. As a result, the pressing head 812N receives force F3 in a direction perpendicular to the second surface 821. The pressing head 812N evades upwards with the force F3. Accordingly, an unreasonable force different from the pivoting direction of the pressing member 81 does not easily act of the pressing member 81 of the second exemplary embodiment.

An action when performing recording on the medium M will be described next. While the pressing member 81 is positionally set at a position that does not come in contact with the lateral edge Ms of the medium M, when skewing occurs in the medium M, there are cases in which the lateral edge Ms of the medium M comes in contact with the lateral surface of the pressing head 812 of the pressing member 81. In particular, when double-sided recording is performed, the medium M on which recording on the front surface has been performed is switched back and transported in the second transport direction Y2, is inverted along a roller (not shown) at a position upstream of the recording head 25, and is fed once more with the back surface of the medium M facing upwards. When the medium M is refed during recording on the back surface, a large skew of the medium M tends to occur more easily when compared with when the medium M is fed during recording on the front surface.

Figure 20:
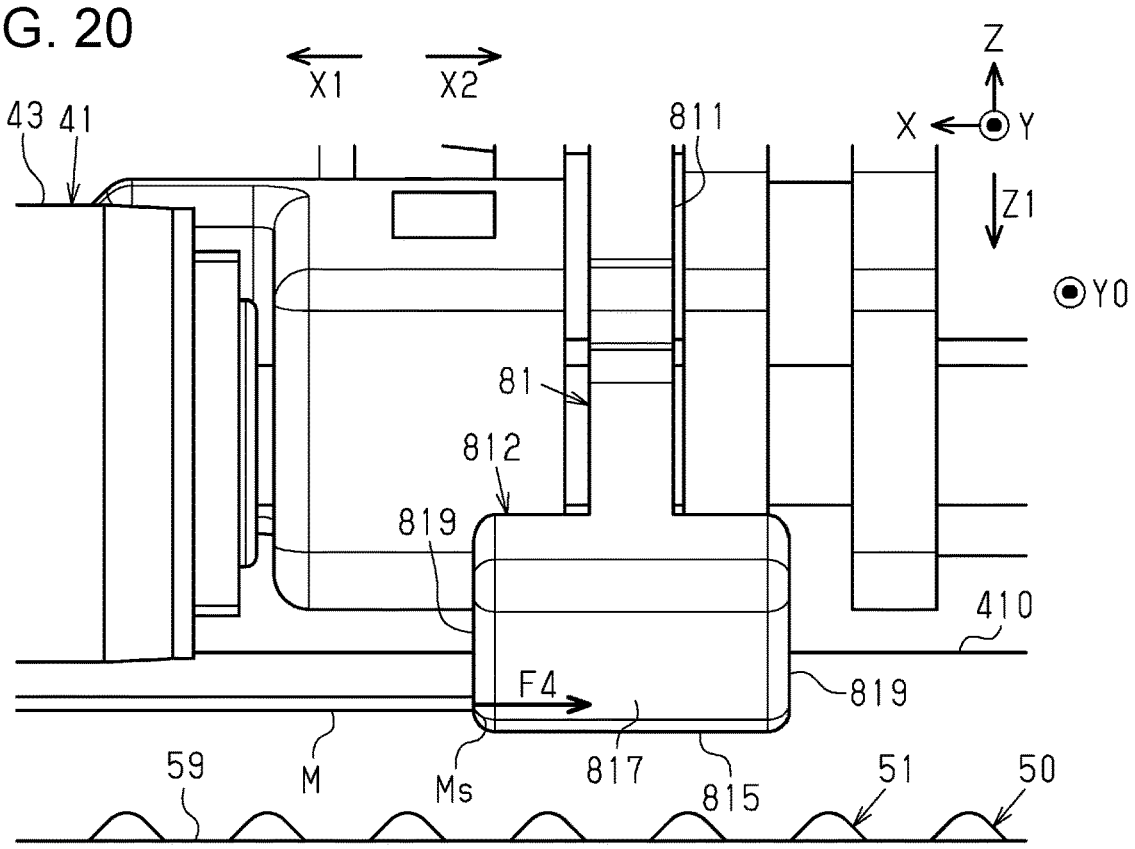
FIG. 20 is a front view illustrating an issue of the pressing member of the first exemplary embodiment that is created when the medium skews.

As illustrated in FIG. 20, in the pressing member 81 of the first exemplary embodiment, when the medium M is skewed while recording is performed on the medium M, the lateral edge Ms of the medium M moves in the width direction X and comes in contact with the lateral surface 819 of the pressing head 812, which is at a position where the medium M does not come in contact therewith. The lateral surface 819 of the pressing head 812 receives force F4 in the width direction X (the second direction X2 in FIG. 20). Accordingly, an unreasonable force that is different from the pivoting direction of the pressing member 81 is applied to the pressing member 81. Furthermore, the lateral edge Ms of the medium M pushed hard by the lateral surface 819 of the pressing head 812 becomes deformed.

Figure 21:
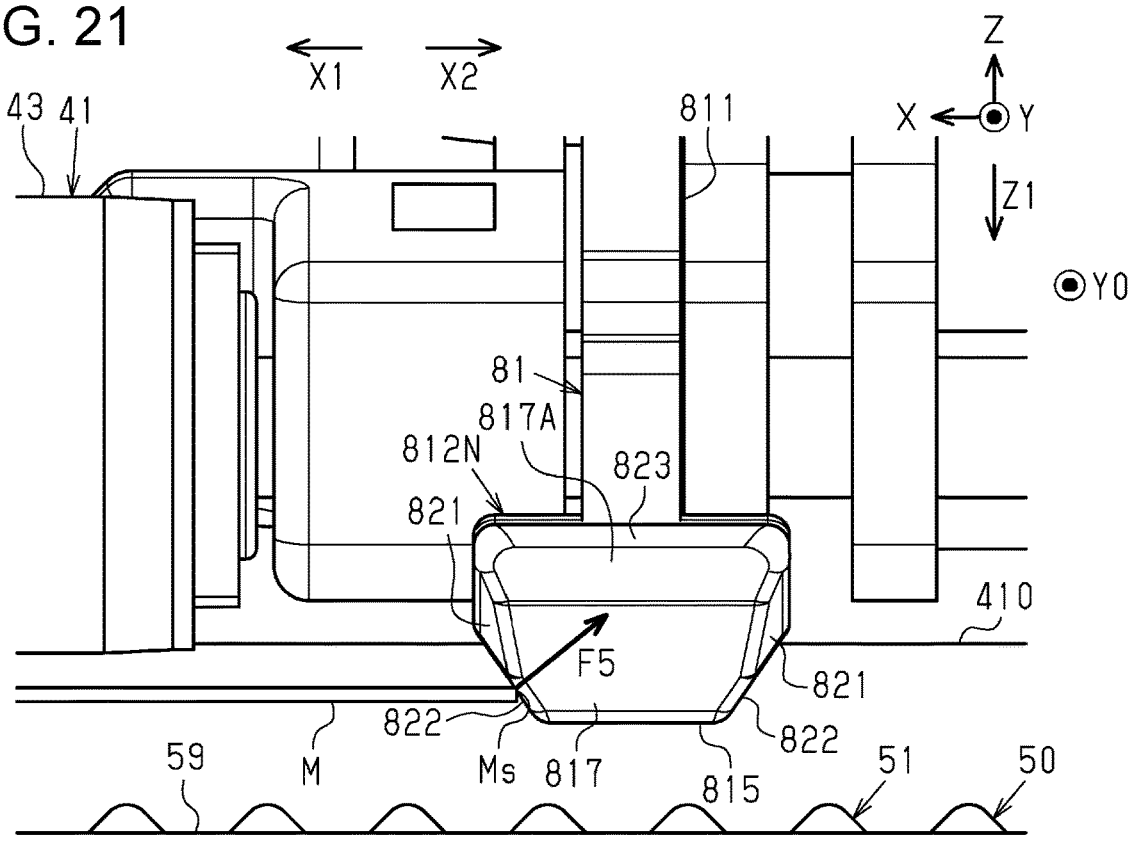
FIG. 21 is a front view illustrating an action of the pressing member of the second exemplary embodiment that is taken when the medium skews.

On the other hand, as illustrated in FIG. 21, in the pressing member 81 of the second exemplary embodiment, when the medium M is skewed while recording is performed on the medium M, the lateral edge Ms of the medium M moves in the width direction X. In the above instance, the third surface 822 of the pressing head 812N is at a height that is the same as that of the medium M on which recording is performed and the third surface 822 is an inclined surface that is inclined in a direction approaching the width center WC as the third surface 822 extends downwards; accordingly, the pressing head 812N receives force F5 from the lateral edge Ms of the medium M in a direction perpendicular to the third surface 822. Accordingly, the pressing head 812N evades upwards. As a result, an unreasonable force different from the pivoting direction of the pressing member 81 does not easily act of the pressing member 81 of the second exemplary embodiment. Furthermore, the lateral edge Ms of the medium M do not become deformed.

An action during double-sided recording when the medium M is switched back and transported will be described next. During double-sided recording, when recording on the front surface of the medium M is ended, in many cases, a rear end Mr of the medium M is positioned downstream of the pressing head 812 of the pressing member 81 in the transport direction Y0. The switch-back transportation, in which the medium M is reverse transported to the second transport direction Y2, is started from the above state. In such a case, the rear end Mr of the medium M may become lifted due to curling.

As illustrated in FIG. 22, in the pressing member 81 of the first exemplary embodiment, since the height dimension in the pressing head 812 where the second guiding surface 817 is formed is only dimension H1, the rear end Mr of the medium M comes in contact with the upper side of the second guiding surface 817 when the rear end Mr of the medium M becomes lifted for more than a predetermined height due to curling during reverse transportation of the medium M, on which recording has been performed on the front surface, in the second transport direction Y2. In such a case, the rear end Mr of the medium M is not guided below the second guiding surface 817. As a result, the rear end Mr of the medium M may impinge against the pressing head 812 of the pressing member 81 or may move above the pressing head 812 to the upper side of the pressing head 812. In such a case, jamming of the medium M may occur.

On the other hand, as illustrated in FIG. 23, in the pressing member 81 of the second exemplary embodiment, when the medium M on which recording has been performed on the first surface is reverse transported in the second transport direction Y2 during double-sided recording, even if the rear end Mr of the medium M is lifted above a predetermined height due to curling, the rear end Mr of the medium M comes in contact with the first surface 817A. In other words, since the height dimension H2, or the sum of the heights of the second guiding surface 817 and the first surface 817A in the pressing head 812N, is larger than the dimension H1, the rear end Mr of the medium M comes in contact with the first surface 817A. Furthermore, the rear end Mr of the medium M is guided along the first surface 817A to the second guiding surface 817 and, furthermore, guided from the second guiding surface 817 to the abutting portion 815 therebelow. As a result, the medium M passes below the pressing heads 812 and is nipped by the pairs of transport rollers 41 and, furthermore, is reverse transported in the second transport direction Y2 with the pairs of transport rollers 41. Subsequently, after the medium M is inverted along the roller (not shown) at the position upstream of the recording head 25, the medium M with the back surface facing upwards is refed, with the pairs of transport rollers 41 towards the recording position that opposes a scanning area of the recording head 25. Accordingly, double-sided recording can be performed appropriately without failing to reverse transport the medium M during double-sided recording.

Other than the effects (1) to (11) of the first exemplary embodiment, the following effects (12) to (14) can be obtained with the second exemplary embodiment.

(12) The pressing member 81 includes the first surface 817A at the position above and adjacent to the second guiding surface 817. The first surface 817A is inclined in the same direction as that of the second guiding surface 817. Accordingly, during double-sided recording, after recording on the front surface is ended and before recording of the back surface is performed, even when the rear end Mr of the medium M that is to be reverse transported is lifted higher than the second guiding surface 817 due to curling and the like, after the medium M has been guided along the first surface 817A to the second guiding surface 817, the medium M is further guided along the second guiding surface 817 to the abutting portion 815.

Accordingly, even when the rear end Mr of the medium M that is to be reverse transported is excessively lifted due to curling and the like, the medium M can be reverse transported through the normal path that passes below the pressing member 81.

(13) The disk tray 28 on which the disk LD that is subject to label recording is inserted by being reverse transported by the transport portion 40 from downstream to upstream in the transport direction Y0. The disk tray 28 includes the extension portion 282 that is extended upstream in the transport direction Y0. Each pressing member 81 is formed across the area in height including the height position at which the disk tray 28 comes in contact with the extension portion 282 inserted between the pairs of transport rollers 41, and includes the corresponding second surface 821 that is inclined in a direction approaching the width center WC of the pressing member 81 as the second surface 821 extends downwards and downstream in the transport direction Y0. Accordingly, in the course of the extension portion 282 of the disk tray 28 being nipped between the pairs of transport rollers 41 to perform label recording, the outer circumferential surfaces of the corner portions 284A of the extension portion 282 come in contact with the second surfaces 821 of the pressing members 81, which evades the pressing members 81 upwards. Accordingly, application of unreasonable force to the pressing members 81 can be prevented.

(14) Each third surface 822 is formed in the side portion adjacent to the first guiding surface 816 of the corresponding pressing member 81 in the width direction X in the area in height including the height position when the medium M is transported. The third surface 822 is inclined in a direction approaching the width center WC of the pressing member 81 as the third surface 822 extends downwards. Accordingly, the lateral edge Ms of the medium M that has been transported while being displaced in the width direction X due to skewing of the medium M comes in contact with the third surface 822 of the pressing member 81. As a result, the pressing member 81 is evaded upwards. Accordingly, force in an unreasonable direction is not applied to the pressing member 81 from the medium M, and deformation of the lateral edge Ms of the medium M can be suppressed.

Note that the exemplary embodiments described above can be modified into forms illustrated in the modification examples described below. Furthermore, an appropriate combination of the exemplary embodiments described above and the modification examples described below can yet be another modification example, and an appropriate combination of the modification examples described below may yet be another modification example.

Figure 24:
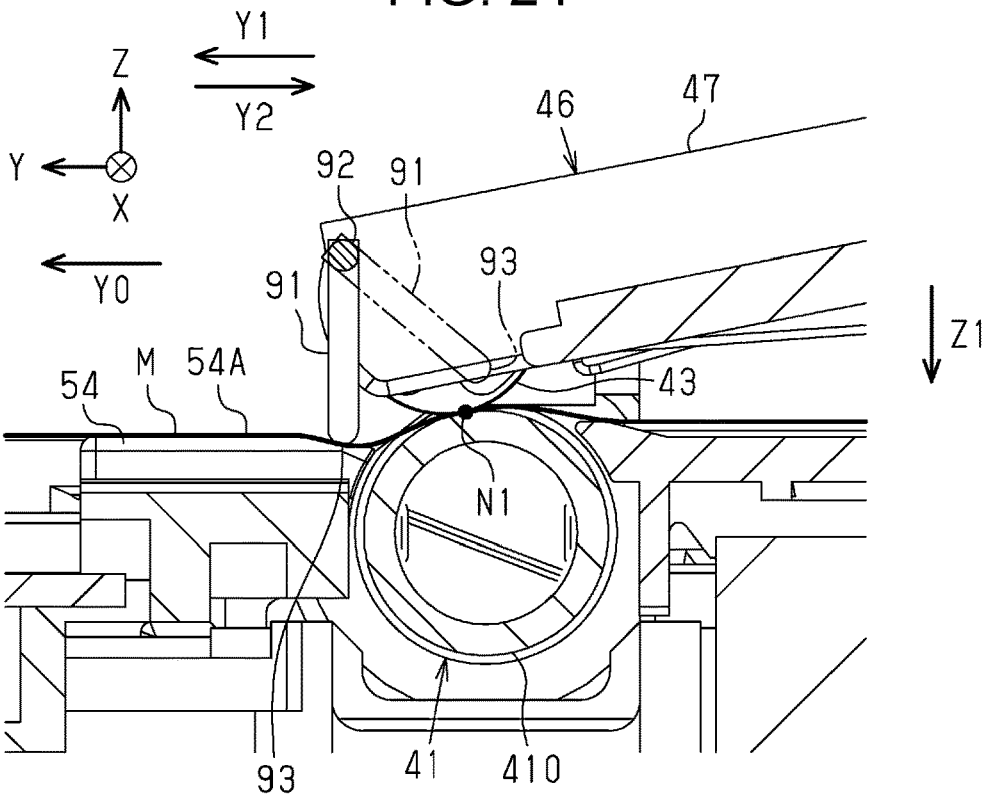
FIG. 24 is a sectional side view illustrating a pressing member according to a modification example.

As illustrated in FIG. 24, the pressing member may be a flap 91 that is pivotably provided at a downstream end portion of the guide member 47, which is an example of the pivoting member, in the transport direction Y0. The flap 91 is pivotably supported about a pivot shaft 92 at the distal end portion of the guide member 47. A distal end portion of the flap 91 is an abutting portion 93. The flap 91 of the present example stands by in a position illustrated by a solid line in FIG. 24, which is hanging down in the vertical direction Z1 by its own weight, for example. The flap 91 is restricted from rotating further in the clockwise direction in FIG. 24 from the standby position illustrated by the solid line in FIG. 24. Furthermore, the flap 91 is allowed to pivot in the counterclockwise direction in FIG. 24 from the standby position illustrated by the solid line in FIG. 24. The disposition condition of the pressing members in the width direction X, and the condition of the abutting portions 93 overlapping the ribs 54 are similar to those of the exemplary embodiments described above. The medium M transported in the first transport direction Y1 is pressed down by the abutting portions 93 of the plurality of flaps 91 at a plurality of portions in the width direction X and are curved into a wave shape that is wavy in the width direction X. As a result, lifting of the medium M is suppressed and ink stains and jamming caused by the medium M being rubbed against the head can be prevented. Furthermore, during double-sided recording, the rear end of the medium M that is reverse transferred in the second transport direction Y2 pushes the flaps 91 and pivots the flaps 91 in the counterclockwise direction in FIG. 24, in which the retracted position depicted by a two-dot chain line in FIG. 24 is the largest-movement position of the flaps 91; accordingly, the medium M can be transported in the second transport direction Y2 without any obstacles. Note that each flap 91 may be biased in the counterclockwise direction in FIG. 24 with an elastic member (not shown) that has force that, when the medium transported in the first transport direction Y1 pushes the flaps 91, does not allow the first medium that has low rigidity such as plain paper and the like to displace the flaps 91 in the standby position and that allows the second medium that has high rigidity such as photographic paper and the like to displace the flaps 91 in the standby position.

Figure 25:
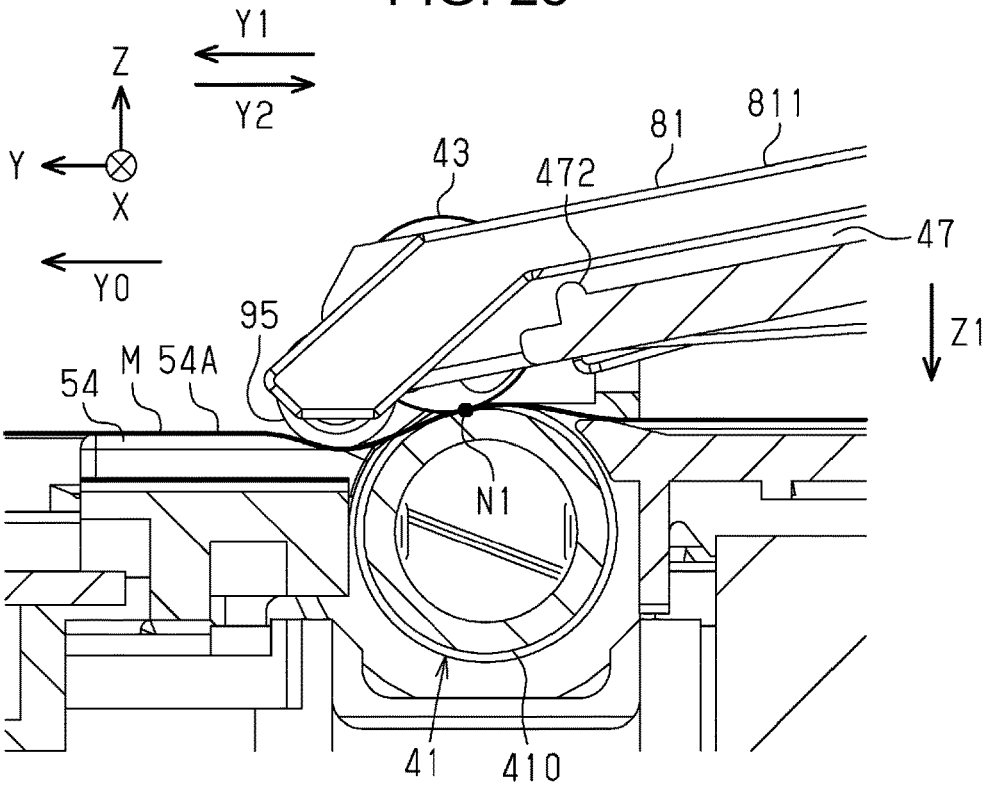
FIG. 25 is a sectional side view illustrating a pressing member according to a modification example that is different from that in FIG. 24.

As illustrated in FIG. 25, the pressing member 81 may be configured to include a rotatable roller 95 at a portion where the medium M is pressed down. In other words, the rotatable roller 95 is attached to the distal end portion of the arm 811 of the pressing member 81 in place of the pressing head 812 of the exemplary embodiments described above. The roller 95 is rotated by friction between the front surface of the medium M transported in the transport direction Y0. In the pressing member 81 of the exemplary embodiments described above, the abutting portion 815 slides along the front surface of the medium M; accordingly, the front surface of the medium M is susceptible to damage. Conversely, since the roller 95 rolls along the front surface of the medium M, the front surface of the medium M is less likely to become damaged. Note that the disposition condition of the pressing members 81 in the width direction X illustrated in FIG. 25 and the condition in which the rollers 95 overlap the ribs 54 are similar to those of the abutting portions 815 in the exemplary embodiments described above. Accordingly, lifting of the medium M can be suppressed by curving the medium M into a wave shape without damaging the medium by pressing down the medium M with the plurality of rollers 95 in the width direction X. Note that the roller 95 may be substituted with a ball that is supported at the distal end portion of the arm 811 in a rollable manner.

Figure 26:
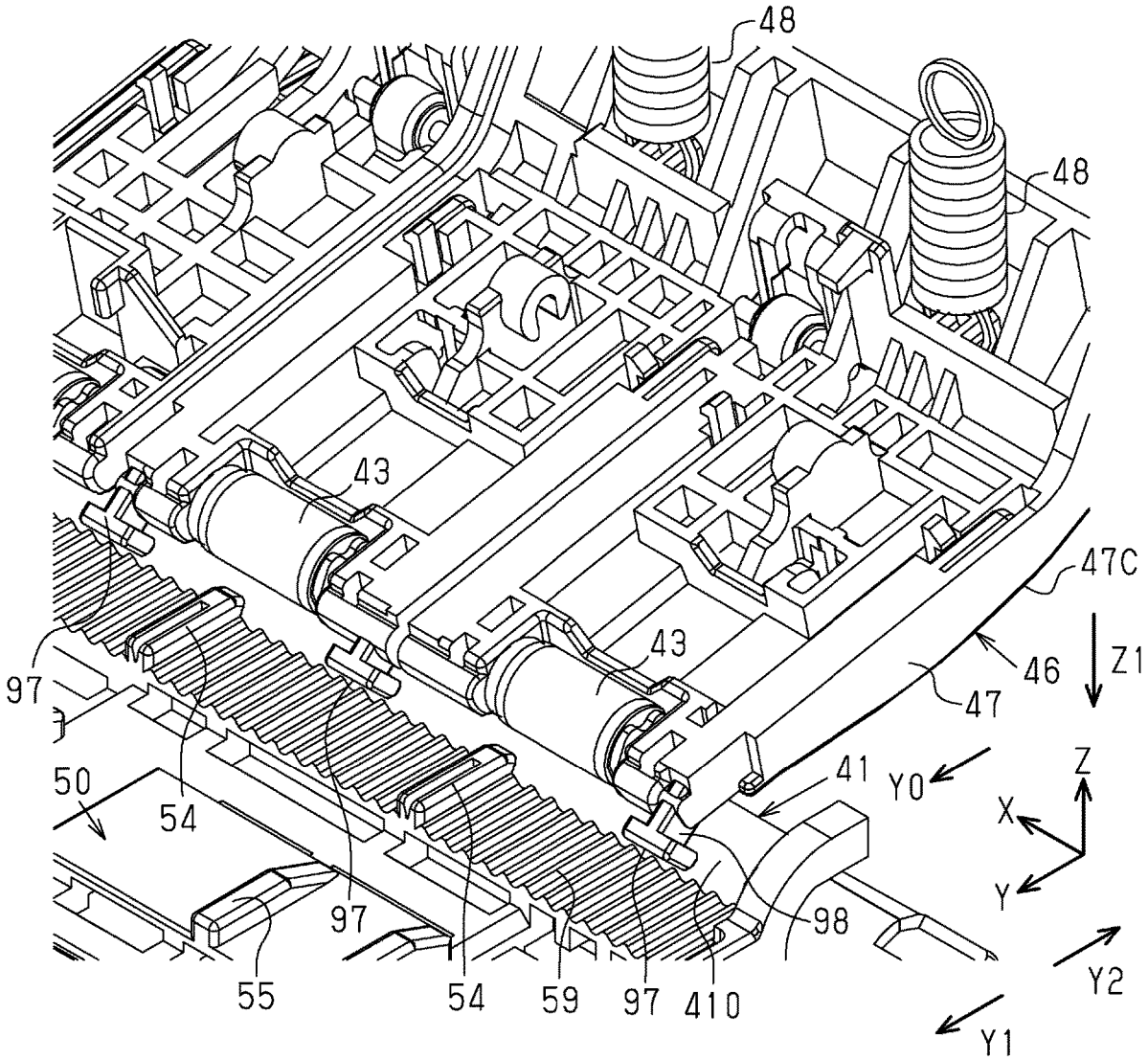
FIG. 26 is a perspective view illustrating a pressing member according to a modification example that is different from that in FIG. 25.

As illustrated in FIG. 26, pressing members 97 may extend out from a downstream end portion of the guide member 47, which is an example of the pivoting member that constitutes the medium guiding mechanism 46, in the transport direction Y0. Specifically, each pressing member 97 includes an arm 98 that extends out from the distal end portion of the guide member 47 in the transport direction Y0, and the pressing head 812 that are similar to that of the exemplary embodiments described above and that is provided at a distal end portion of the arm 98 so as to protrude in the width direction X. In the lower portion of the pressing head 812 in the vertical direction Z1, there is the abutting portion 815 (see FIG. 11) having a wide shape that protrudes in the width direction X of the arm 98. According to such a configuration, the pressing members 81 can be supported at positions corresponding to the ribs 54 of the support member 50 by using the guide member 47 that supports the driven rollers 43. Furthermore, the pressing members 97 can be formed integrally with the guide member 47. Furthermore, since the movement of the pressing members 97 is carried out by a pivoting member of the guide member 47, and the biasing force of the pressing members 97 in the pressing direction is applied with the biasing members 48 of the medium guiding mechanism 46, the elastic members 83 will not be needed and the parts can be reduced. Furthermore, installing work of installing the pressing members 97 in the guide member 47 is not needed. Accordingly, the number of parts can be reduced and the manufacturing cost of the medium guiding mechanism 46 including the pressing members 97 can be reduced.

In the exemplary embodiments described above and the modification examples illustrated in FIGS. 24 to 26, a single or a plurality of pressing members may be provided at all of the positions opposing the recessed areas 59.

In FIG. 26, in place of the pressing heads 812, the rollers 95 illustrated in FIG. 25 may be provided.

The pressing member 81 is not limited to being provided in the guide member that is an example of the pivoting member, and may be supported by a frame, for example. In such a case, the pressing member 81 is moveably supported by the frame. Furthermore, the elastic member 83 that biases the pressing member 81 in the pressing direction may be provided.

The height position of the abutting portion 815 when the pressing member 81 is in the standby position may be a position above the support surface 54A of the rib 54 with which the medium M is supported. It is only sufficient that the abutting portion 815 of the pressing member 81 is at a position that is closer to the support member 50 than the recording head 25. With the above, the medium M can be restricted from lifting up to a position where the medium M comes in contact with the recording head 25.

The pressing direction PD is not limited to a direction that presses down the medium M towards the support surface 54A and may be any direction that restricts the transported medium M from lifting.

The disposed position of the pressing member is not limited to the position where the abutting portion 815 opposes the support member 50. For example, if there are areas downstream of the nip positions N1 of the pairs of transport rollers 41 in the transport direction Y0 and upstream of the recording head 25 where the support member is not present, the areas may be the opposing positions of the abutting portions 815.

In the exemplary embodiments described above, the elastic members 83 that are closer to the middle portion in the width direction X can be made to have stronger biasing force. With such a configuration, the portion around the middle of the medium in the width direction X can also be curved into an appropriate wave shape.

The pressing members 81 may be controlled with the control portion 100. For example, the pressing members 81 may be retracted to the retracted position above the support surfaces 54A for mediums M with high rigidity. For example, the pressing members 81 are driven by motive power of an electric motor serving as a drive source. The control portion 100 controls the electric motor to move the pressing members 81 to the retracted position and a pressing position. The control portion 100 acquires information on the type of medium included in the print data and moves the pressing members to either the retracted position or the pressing position that is in accordance with the type of medium specified based on the information on the type of medium. For example, when the type of medium is photographic paper, the control portion 100 retracts the pressing members 81 to the retracted position. As a result, the pressing members are not rubbed against the photographic paper; accordingly, the photographic paper is less likely to become damaged. When the type of medium is plain paper, the pressing members 81 are disposed at the pressing position. As a result, lifting of the medium M can be suppressed.

The first guiding surfaces 816 may be provided and the second guiding surfaces 817 may not be provided in the first exemplary embodiment. For example, in the recording apparatus 11 in which the reverse transport path through which the medium M is reverse transported during double-sided recording is a path different from the transport path during recording, it is only sufficient that the first guiding surfaces 816 are provided. Furthermore, in a recording apparatus that does not possess a double-sided recording function, it is only sufficient that the first guiding surfaces 816 are provided. Note that the reverse transport path may be a path passing above the transport path or a path passing below the transport path.

The second exemplary embodiment may lose one of the second surface 821 in the pair of second surfaces 821. There may be only one second surface 821 on the side with which one of the corner portions 284A of the extension portion 282 comes in contact, or there may be only one second surface 821 in a configuration in which the corner portion 284A that comes in contact is only one of the two corner portions 284A.

The second exemplary embodiment may lose one of the third surface 822 of the pair of third surfaces 822. There may be only a single third surface 822 on the side with which the lateral edge Ms of the medium M comes in contact, or there may be only a single third surface 822 in a configuration in which the lateral edge Ms that comes in contact is only one of the two lateral edges Ms.

In the second exemplary embodiment, the pressing member 81 may be provided with only one of the first surface 817A, the second surface 821, and the third surface 822, or may be provided with two of the first surface 817A, the second surface 821, and the third surface 822. For example, the pressing member 81 may be provided with the first surface 817A alone. Furthermore, the plurality of pressing members 81 may be a mixture of the pressing member 81 with only the first surface 817A, the pressing member 81 with only the second surface 821, and the pressing member 81 with only the third surface 822.

The support member 50 may be configured without the ribs. In such a case, the positions of the abutting portions 815 of the pressing members 81 at the standby position may be any positions above the support surfaces with which the medium M is supported, and below the recording head 25.

The pressing members 81 are not limited to being disposed at positions that oppose the recessed areas, which are portions that are not the protruded portions in the support member 50 including the protruded and recessed shape in the width direction X, in the vertical direction Z1. The pressing members 81 may be disposed at positions where the abutting portions 815 oppose the ribs 54 of the support member 50.

The number of pressing members may be one. For example, the abutting portions 815 may be disposed at the standby position that is higher than the support surfaces 54A, and a plurality of pressing heads 812 may be connected in the width direction X as a single pressing head 812. Furthermore, a single pressing member 81 may be provided in the middle portion in the width direction X. Lifting of the medium M can be suppressed with the above configurations.

The transport portion 40 may be of a roller-transport type or of a belt-transport type.

The recording apparatus 11 is not limited to a serial printer in which the recording portion 23 reciprocates in the scanning direction X, and may be a lateral type printer in which the recording portion 23 is configured to move in two directions, namely, the main scanning direction and the sub scanning direction. Furthermore, the recording apparatus 11 may be a line printer.

The recording apparatus 11 may be a multifunction machine on which a reading unit is mounted.

The medium M is not limited to a sheet of paper and may be a flexible plastic film, cloth, non-woven fabric, or a laminate.

The recording apparatus 11 is not limited to a recording apparatus that prints on a medium such as a sheet of paper and may be a printing machine that prints on a cloth.

The recording apparatus 11 is not limited to a recording apparatus of an ink jet type, and may be a wire impact recording apparatus or a thermal transfer recording apparatus. Such recording apparatuses can also reduce contact between the medium lifted from the support surface, and the recording head.

The recording apparatus is not limited to a printer for printing. For example, the recording apparatus may be a recording apparatus that manufactures pixels of various types of displays such as an electrical wiring pattern, liquid crystal, electroluminescence (EL), and plane emission on a substrate, which is an example of a medium, by discharging a liquid material formed by dispersing or mixing particles of a functional material into liquid.

Technical ideas ascertained from the exemplary embodiments described above and the modification examples will be described hereinafter together with the advantageous effects thereof.

(A) A recording apparatus including a feed portion that feeds a medium, a transport portion that transports the fed medium in a transport direction, a recording portion that performs recording on the medium transported by the transport portion, a support member that includes a support surface that supports the medium on which the recording portion performs recording, and a pressing member that presses the medium towards the support member, at a position upstream of the recording position of the recording portion in the transport direction. In the recording apparatus, the pressing member is provided so as to be movable in a direction intersecting the support surface.

According to the above configuration, lifting of the medium can be suppressed by the pressing member pressing down the medium, and the medium coming in contact with the recording portion due to being lifted can be reduced. Furthermore, since the pre-printing positions of the medium upstream of the recording position in the transport direction are pressed down, the recorded image does not become damaged. Furthermore, since contamination such as recording ink is not transferred to the pressing member, the contamination transferred to the pressing member being transferred to the other mediums and staining the other mediums can be prevented. Furthermore, since the pressing member is movable in the direction intersecting the support surface, which is the lifting direction of the medium, when the medium has high rigidity, for example, the medium is less likely to become damaged when the pressing member is retracted in a direction away from the support surface.

(B) The recording apparatus described above may include an elastic member that biases the pressing member in a pressing direction that is a direction approaching the support member.

According to the above configuration, since the pressing member that is provided so as to be movable in the direction intersecting the support surface is biased in the pressing direction, when the medium has high rigidity, for example, the medium is less likely to become damaged when the pressing member is retracted in a direction away from the support surface.

(C) In the recording apparatus described above, the transport portion may include a pair of transport rollers, the pair of transport rollers being a pair formed by a driving roller and a driven roller, a pivoting member that is pivotably supported while supporting the driven roller at a downstream end portion in the transport direction, and a biasing member that biases the pivoting member in a direction in which the driven roller approaches the driving roller, and the pressing member may be provided at the downstream end portion of the pivoting member in the transport direction while being biased in the pressing direction with the elastic member.

According to the above configuration, the pressing member can be disposed at a position corresponding to the rib of the support member by using the pivoting member that supports the driven roller.

(D) In the recording apparatus described above, the pressing member may include an abutting portion that abuts against the medium when pressing down the medium, and a first guiding surface that guides a front end of the medium, which is transported in the transport direction, to the abutting portion.

According to the above configuration, even when the front end portion of the medium transported in the transport direction is lifted, the front end portion is guided along the first guiding surface of the pressing member to the abutting portion. Accordingly, the front end portion of the medium being lifted and coming in contact with the recording portion can be suppressed.

(E) In the recording apparatus described above, the pressing member may include a second guiding surface that guides a rear end of the medium, which is reverse transported upstream in the transport direction, to the abutting portion.

According to the above configuration, even when the rear end portion of the medium reverse transported is lifted, the rear end portion is guided along the second guiding surface of the pressing member to the abutting portion. Accordingly, even when the rear end of the medium that is reverse transported becomes lifted, the medium can be smoothly reverse transported.

(F) In the recording apparatus described above, the pressing member may include an abutting portion that abuts against the medium when pressing down the medium, and a pivot fulcrum positioned upstream of the abutting portion in the transport direction, in which the second guiding surface may be set at an angle in which an upward direction orthogonal to the second guiding surface at a predetermined position is above an imaginary line connecting the predetermined position on the second guiding surface and the pivot fulcrum.

According to the above configuration, when the medium is reverse transported, the rear end of the reverse transported medium with high rigidity moves along the second guiding surface, which can lift the pressing member. Furthermore, by moving the rear end of the medium M, which is reverse transported, with a low rigidity along the second guiding surface, the rear end of the medium can be guided to the abutting portion. Accordingly, the medium M can be smoothly reverse transported.

(G) In the recording apparatus described above, the pressing member may include a first surface at a position above and adjacent to the second guiding surface, the first surface being inclined in a direction that is the same as that of the second guiding surface.

According to the above configuration, during double-sided recording, after recording on the front surface is ended and before recording of the back surface is performed, even when the rear end of the medium that is to be reverse transported is lifted higher than the second guiding surface due to curling and the like, after the medium has been guided along the first surface, which is adjacent and above the second guiding surface, to the second guiding surface, the medium is further guided along the second guiding surface to the abutting portion. Accordingly, even when the rear end of the medium that is to be reverse transported is excessively lifted due to curling and the like, the medium can be reverse transported through the normal path that passes below the pressing member.

(H) Regarding the recording apparatus described above, in a disk tray on which a disk that is subject to label recording that performs recording on a label surface of the disk is reverse transported from downstream to upstream in the transport direction by the transport portion, the disk tray may include an extension portion that extends upstream in the transport direction, and the pressing member may include a second surface that is formed across an area in height that includes a height position at which the disk tray comes in contact with the extension portion when the disk tray is reverse transported by the transport portion, and that is inclined in a direction that approaches a width center of the pressing member as the second surface extends downwards and downstream in the transport direction.

According to the above configuration, when inserting the disk tray on which the disk has been mounted to perform label recording, in the course of nipping the extension portion of the disk tray between the pair of transport rollers, the corner portion of the extension portion comes in contact with the second surface of the pressing member and the pressing member is evaded upwards.

(I) The recording apparatus described above further includes a third surface at a lateral portion adjacent to the first guiding surface of the pressing member in the width direction, the third surface being formed across an area in height including a height position where the medium is transported, and being inclined in a direction that approaches the width center of the pressing member as the third surface extends downwards.

According to the above configuration, the lateral edge of the medium that has been transported while being displaced in the width direction due to skewing of the medium comes in contact with the third surface of the pressing member. As a result, the pressing member is evaded upwards. Accordingly, force in an unreasonable direction is not applied to the pressing member from the medium, and deformation of the lateral edge of the medium can be suppressed.

(J) In the recording apparatus described above, the support member may include a plurality of ribs positioned at intervals in a width direction that intersects the transport direction, the ribs each including the support surface at an end surface thereof, and a plurality of recessed areas that are areas other than the plurality of ribs and that are areas lower in height than the ribs. The plurality of pressing members may each include an abutting portion that abuts against the medium when pressing down the medium, the abutting portion being disposed at a position opposing a recessed area of the plurality of recessed areas of the support member.

According to the above configuration, contact between the pressing members and the ribs can be prevented. For example, when the ribs are stained with ink and the like, the contamination is transferred to the pressing members that have come in contact with the ribs and, subsequently, the contamination is transferred to the medium from the pressing members. The medium M can be prevented from becoming stained due to the above type of cause. Furthermore, it will be possible to press the medium deeper down with respect to the support surfaces of the ribs. For example, the medium can be curved into a wave shape.

(K) In the recording apparatus described above, the support member may include a plurality of ribs each including the support surface at an end surface thereof, and when the pressing member is positioned at where the pressing member has moved the most in a pressing direction, the abutting portion may overlap the support surface of a rib of the plurality of ribs in an orthogonal direction, which is orthogonal to the support surface, and in the transport direction.

According to the above configuration, since the plurality of pressing members oppose the recessed areas that are areas other than the ribs of the support member, the medium can be curved into a wave shape by pressing down the medium to a portion deeper than the support surfaces. Accordingly, contact between the transported medium and the recording portion can be reduced.

(L) In the recording apparatus described above, the pressing member may be provided at least at positions between outermost ribs that support both edge portions of the largest-sized medium in the width direction and ribs positioned inside and next to the outermost ribs in the width direction.

According to the above configuration, since the waves can be formed at the end portions of the medium, which are portions where the waves can be formed easily, appropriate-sized waves can be formed reliably without excessively loading the medium, and the lifting of the transported medium from the support surfaces can be suppressed. Note that compared with pressing down the end portions of the medium in the width direction, the middle portion of the medium in the width direction is not easily flexed when the medium is pressed down. The medium can be flexed more easily and curved into a wave shape more easily by pressing down portions near the end portions, which are free ends of the medium.

(M) In the recording apparatus described above, the transport portion may include a pair of transport rollers, the pair of transport rollers being a pair formed by a driving roller and a driven roller, a pivoting member that is pivotably supported and that supports the driven roller at a downstream end portion in the transport direction, and a biasing member that biases the pivoting member in a direction in which the driven roller approaches the driving roller. The pressing member extends from a downstream end portion of the pivoting member in the transport direction.

According to the above configuration, the pressing member can be supported at a position corresponding to the rib of the support member by using the pivoting member that supports the driven roller. Furthermore, since the biasing force of the pressing member is applied from the biasing member, the elastic member will not be needed and the parts can be reduced.

(N) In the recording apparatus described above, the pressing member may include an arm and, at a distal end portion of the arm, an abutting portion that abuts against the medium when pressing down the medium, and the abutting portion may have, with respect to the arm, a wide shape protruded in the width direction that intersects the transport direction According to the above configuration, since the abutting portion of the pressing member is protruded in the width direction with respect to the arm, compared with a configuration in which the dimension of the abutting portion of the pressing member in the width direction is the same as that of the arm, a wider portion of the medium M can be pressed down. For example, the medium can be curved into an appropriate wave shape without creating small folds and indentations such as scratches in the medium.

(O) In the recording apparatus described above, the pressing member may include a rotatable roller in a portion where the medium is pressed down.

According to the above configuration, since the medium is pressed down with the roller, the medium is less likely to become damaged.

(P) In the recording apparatus described above, the pressing member may be a pivotable flap.

According to the above configuration, the medium is less likely to become damaged since the medium is pressed down with the flap and the flap will pivot when pressed hard against the medium.

What is claimed is:

1. A recording apparatus comprising:

a feed portion that feeds a medium;

a transport portion that transports the fed medium in a transport direction;

a recording portion that performs recording on the medium transported by the transport portion;

a support member that includes a support surface that supports the medium on which the recording portion performs recording; and a pressing member that presses the medium towards the support member, at a position upstream of the recording position of the recording portion in the transport direction, wherein the pressing member is provided so as to be movable in a direction intersecting the support surface, the pressing member includes an abutting portion that abuts against the medium when pressing down the medium, and a first guiding surface that guides a front end of the medium, which is transported in the transport direction, to the abutting portion, a third surface at a lateral portion adjacent to the first guiding surface of the pressing member in the width direction, the third surface being formed across an area in height including a height position where the medium is transported, and being inclined in a direction that approaches the width center of the pressing member as the third surface extends downwards.

2. The recording apparatus according to claim 1, further comprising:

an elastic member that biases the pressing member in a pressing direction that is a direction approaching the support member.

3. The recording apparatus according to claim 2, wherein the transport portion includes a pair of transport rollers, the pair of transport rollers being a pair formed by a driving roller and a driven roller, a pivoting member that is pivotably supported while supporting the driven roller at a downstream end portion in the transport direction, and a biasing member that biases the pivoting member in a direction in which the driven roller approaches the driving roller, and the pressing member is provided at the downstream end portion of the pivoting member in the transport direction while being biased in the pressing direction with the elastic member.

4. The recording apparatus according to claim 1, wherein the pressing member includes a second guiding surface that guides a rear end of the medium, which is reverse transferred upstream in the transport direction, to the abutting portion.

5. The recording apparatus according to claim 4, wherein the pressing member includes a pivot fulcrum positioned upstream of the abutting portion in the transport direction, and the second guiding surface is set at an angle that receives an upward force so that a direction of the force that the second guiding surface receives and that is orthogonal to the second guiding surface when the rear end of the medium abuts against the second guiding surface at a predetermined position is directed upwards with respect to an imaginary line connecting the predetermined position on the second guiding surface and the pivot fulcrum.

6. The recording apparatus according to claim 4, wherein the pressing member includes a first surface at a position above and adjacent to the second guiding surface, the first surface being inclined in a direction that is the same as that of the second guiding surface.

7. The recording apparatus according to claim 1, wherein the support member includes a plurality of ribs positioned at intervals in a width direction that intersects the transport direction, the ribs each including the support surface at an end surface thereof, and a plurality of recessed areas that are areas other than the plurality of ribs and that are areas lower in height than the ribs, and the pressing member includes an abutting portion that abuts against the medium when pressing down the medium, the abutting portion being disposed at a position opposing a recessed area of the plurality of recessed areas of the support member.

8. The recording apparatus according to claim 7, wherein when the pressing member is positioned at where the pressing member moved the most in a pressing direction, the abutting portion overlaps the support surface of a rib of the plurality of ribs in an orthogonal direction, which is orthogonal to the support surface, and in the transport direction.

9. The recording apparatus according to claim 7, wherein the pressing member is provided at least at positions between outermost ribs that support both edge portions of a largest-sized medium in the width direction and ribs positioned inside and next to the outermost ribs in the width direction.

10. The recording apparatus according to claim 1, wherein the transport portion includes a pair of transport rollers, the pair of transport rollers being a pair formed by a driving roller and a driven roller, a pivoting member that is pivotably supported and that supports the driven roller at a downstream end portion in the transport direction, and a biasing member that biases the pivoting member in a direction in which the driven roller approaches the driving roller, and the pressing member extends from a downstream end portion of the pivoting member in the transport direction.

11. The recording apparatus according to claim 1, wherein the pressing member includes an arm and, at a distal end portion of the arm, an abutting portion that abuts against the medium when pressing down the medium, and the abutting portion has, with respect to the arm, a wide shape protruded in the width direction that intersects the transport direction.

12. The recording apparatus according to claim 1, wherein the pressing member includes a rotatable roller in a portion where the medium is pressed down.

13. The recording apparatus according to claim 1, wherein the pressing member is a pivotable flap.

14. A recording apparatus comprising:

a feed portion that feeds a medium;

a transport portion that transports the fed medium in a transport direction;

a recording portion that performs recording on the medium transported by the transport portion;

a support member that includes a support surface that supports the medium on which the recording portion performs recording; and a pressing member that presses the medium towards the support member, at a position upstream of the recording position of the recording portion in the transport direction, wherein the pressing member is provided so as to be movable in a direction intersecting the support surface, the pressing member includes an abutting portion that abuts against the medium when pressing down the medium, and a first guiding surface that guides a front end of the medium, which is transported in the transport direction, to the abutting portion, a disk tray on which a disk that is subject to label recording that performs recording on a label surface of the disk is reverse transported from downstream to upstream in the transport direction by the transport portion, the disk tray includes an extension portion that extends upstream in the transport direction, and the pressing member includes a second surface that is formed across an area in height that includes a height position at which the disk tray comes in contact with the second surface when the disk tray is reverse transported by the transport portion, and that is inclined in a direction that approaches a width center of the pressing member as the second surface extends downwards and downstream in the transport direction.

* * * * *